US006491017B1

(12) United States Patent
Mahr et al.

(10) Patent No.: US 6,491,017 B1
(45) Date of Patent: Dec. 10, 2002

(54) COMBINED STROKE/PRESSURE CONTROLLED FUEL INJECTION METHOD AND SYSTEM FOR AN INTERNAL COMBUSTION ENGINE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,874

(22) PCT Filed: Aug. 2, 2000

(86) PCT No.: PCT/DE00/02577

§ 371 (c)(1),
(2), (4) Date: Jul. 27, 2001

(87) PCT Pub. No.: WO01/14713

PCT Pub. Date: Mar. 1, 2001

(30) Foreign Application Priority Data

Aug. 20, 1999 (DE) ..... 199 39 421

(51) Int. Cl.[7] ..... F02B 3/10

(52) U.S. Cl. ..... 123/299; 123/447; 123/300; 123/304

(58) Field of Search ..... 123/299, 300, 123/304, 447

(56) References Cited

U.S. PATENT DOCUMENTS

| | | | | | |
|---|---|---|---|---|---|
| 4,440,134 | A | * | 4/1984 | Nakao et al. | 123/447 |
| 4,719,889 | A | * | 1/1988 | Amann et al. | 123/447 |
| 5,517,972 | A | * | 5/1996 | Stockner | 123/496 |
| 5,642,714 | A | * | 7/1997 | Buckley | 123/447 |
| 5,732,679 | A | * | 3/1998 | Takahasi et al. | 123/447 |
| 6,112,721 | A | * | 9/2000 | Kouketsu et al. | 123/447 |

* cited by examiner

*Primary Examiner*—Erick Solis
(74) *Attorney, Agent, or Firm*—Ronald E. Greigg

(57) ABSTRACT

In a method for injecting fuel at at least two differently high fuel pressures via injectors into the combustion chamber of an internal combustion engine, the fuel injection at the lower fuel pressure takes place under stroke control, and the fuel injection at the higher fuel pressure takes place under pressure control. For a pre- and/or post-injection and/or a boot injection at the lower fuel pressure, the control chamber and via a check valve the nozzle chamber as well are connected to a low-pressure fuel supply, and that for a main injection at the higher fuel pressure, the nozzle chamber is connected to the high-pressure fuel supply.

14 Claims, 24 Drawing Sheets

COMBINED STROKE/PRESSURE CONTROLLED FUEL INJECTION METHOD AND SYSTEM FOR AN INTERNAL COMBUSTION ENGINE

CROSS REFERENCE TO RELATED APPLICATIONS

This application is a 35 USC 371 application of PCT/DE 00/02577 filed on Aug. 02, 2000.

BACKGROUND OF THE INVENTION

1. Field of the Invention

The invention is based on a fuel injection method for an internal combustion engine in which fuel is injected at at least two different high pressures.

2. Description of the Prior Art

One injection system of this type with which this invention is concerned has been disclosed by International Patent Disclosure WO 98/09068, for instance.

For better comprehension of the ensuing description, several terms will first be defined in more detail: In a pressure-controlled fuel injection system, a valve body (such as a nozzle needle) is opened counter to the action of a closing force by the fuel pressure prevailing in the nozzle chamber of an injector, and thus the injection opening is uncovered for an injection of the fuel. The pressure at which fuel emerges from the nozzle chamber into the cylinder is called the injection pressure. The term stroke-controlled fuel injection system is understood in the context of the invention to mean that the opening and closing of the injection opening of an injector takes place with the aid of a displaceable valve member on the basis of the hydraulic cooperation of the fuel pressures in a nozzle chamber and in a control chamber. An arrangement is furthermore described below as central when it is provided jointly for all the cylinders, and as local if it is intended for only a single cylinder.

In the injection system described in WO 98/09068, both the injection at the higher fuel pressure and the injection at the lower fuel pressure are done under stroke control, and the control chamber and nozzle chamber communicate directly with one another. Since the higher injection pressure also prevails in the control chamber, there are corresponding requirements in terms of sealing function, spring forces and a valve member that must be met there as well. The stroke control makes good replicability of the injection at the lower fuel pressure possible.

From European Patent Disclosure EP 0 711 914 A1, a pressure-controlled fuel injection system is known, in which via a valve control unit, either the lower or the higher fuel pressure is carried into the nozzle chamber of the injector. There, by means of the pressure, a spring-loaded valve body is lifted from its valve seat, so that fuel can emerge from the injection opening. In pressure-controlled injection systems, pressure waves are induced in the injection, which although they are wanted in the main injection at the higher fuel pressure can nevertheless, in the pre-injection at the lower fuel pressure, adversely affect the hydraulic behavior of the injection system in the subsequent main injection.

SUMMARY OF THE INVENTION

According to the invention, the advantages of a stroke-controlled and a pressure-controlled injection system are combined. This has decisive advantages:

more-flexible pre-injection and post-injection;

better metering options and good replicability of the pre-injection and post-injection by means of a stroke control and a lower injection pressure;

very small structural size of the injector, since the stroke control, because of the low pressure, can have a 2/2-way valve as its control device;

the use of fast-switching magnet valves which require little current;

only slight influence of component tolerances on the pre-injection and post-injection;

pressure exaggeration in the main injection and a triangular course of injection;

lesser demands in terms of sealing function, spring forces and a valve member because of lesser pressure in the pre-injection and post-injection;

the possibility of choosing the injection principle in the main injection at low injection pressures.

The lower fuel pressure can also be used for the main injection, to realize a bootlike course of injection.

Further advantages and advantageous features of the subject of the invention can be learned from the description, drawings and claims.

BRIEF DESCRIPTION OF THE DRAWING

Various exemplary embodiments of stroke/pressure-controlled fuel injection systems are described herein below and shown schematically in the drawings, in which.

DESCRIPTION OF THE PREFERRED EMBODIMENTS

Figure 1A:
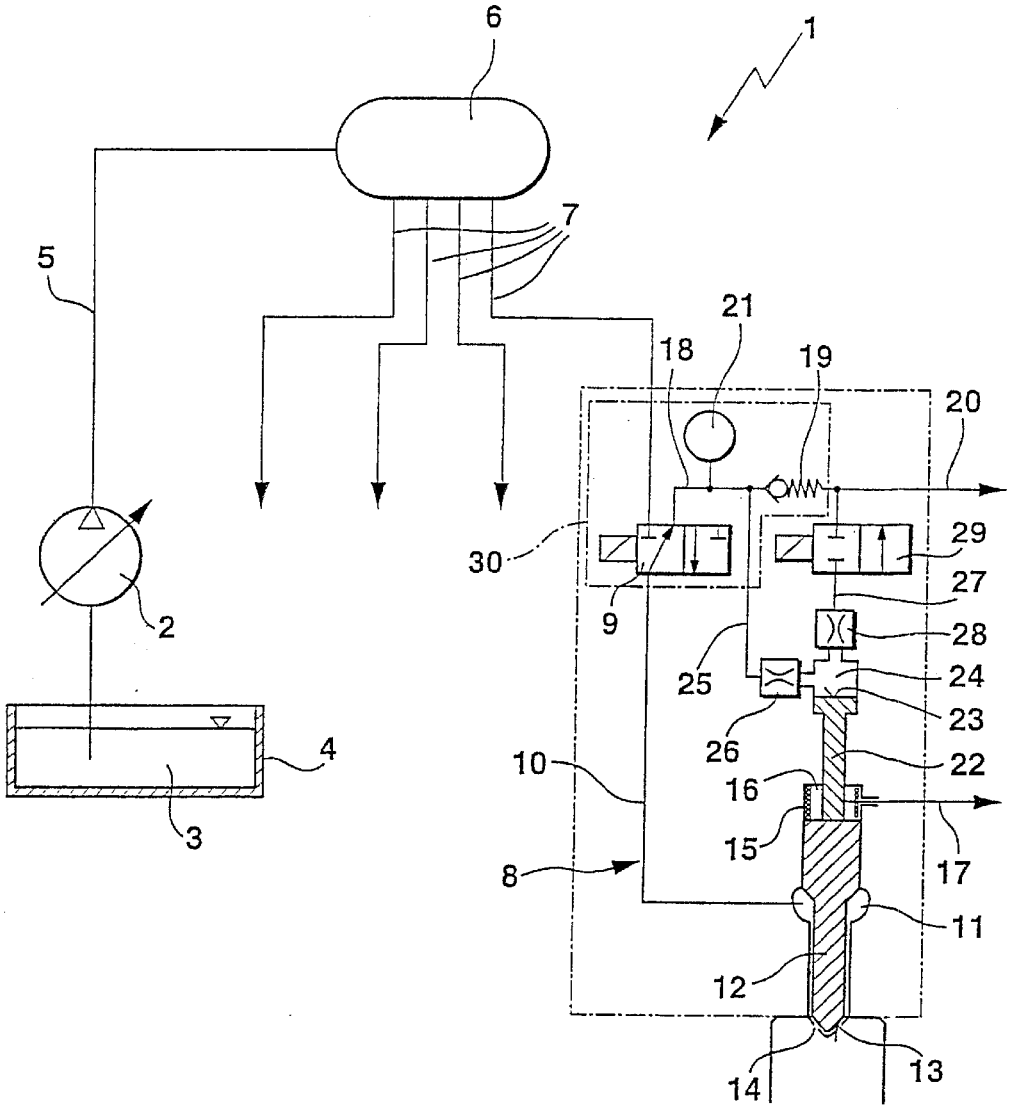
FIGS. 1*a* and 1*b* illustrate a first fuel injection system for an injection at two, differently high fuel pressures, with one central pressure reservoir, and with one local accumulator chamber for each injector.
Figure 1B:
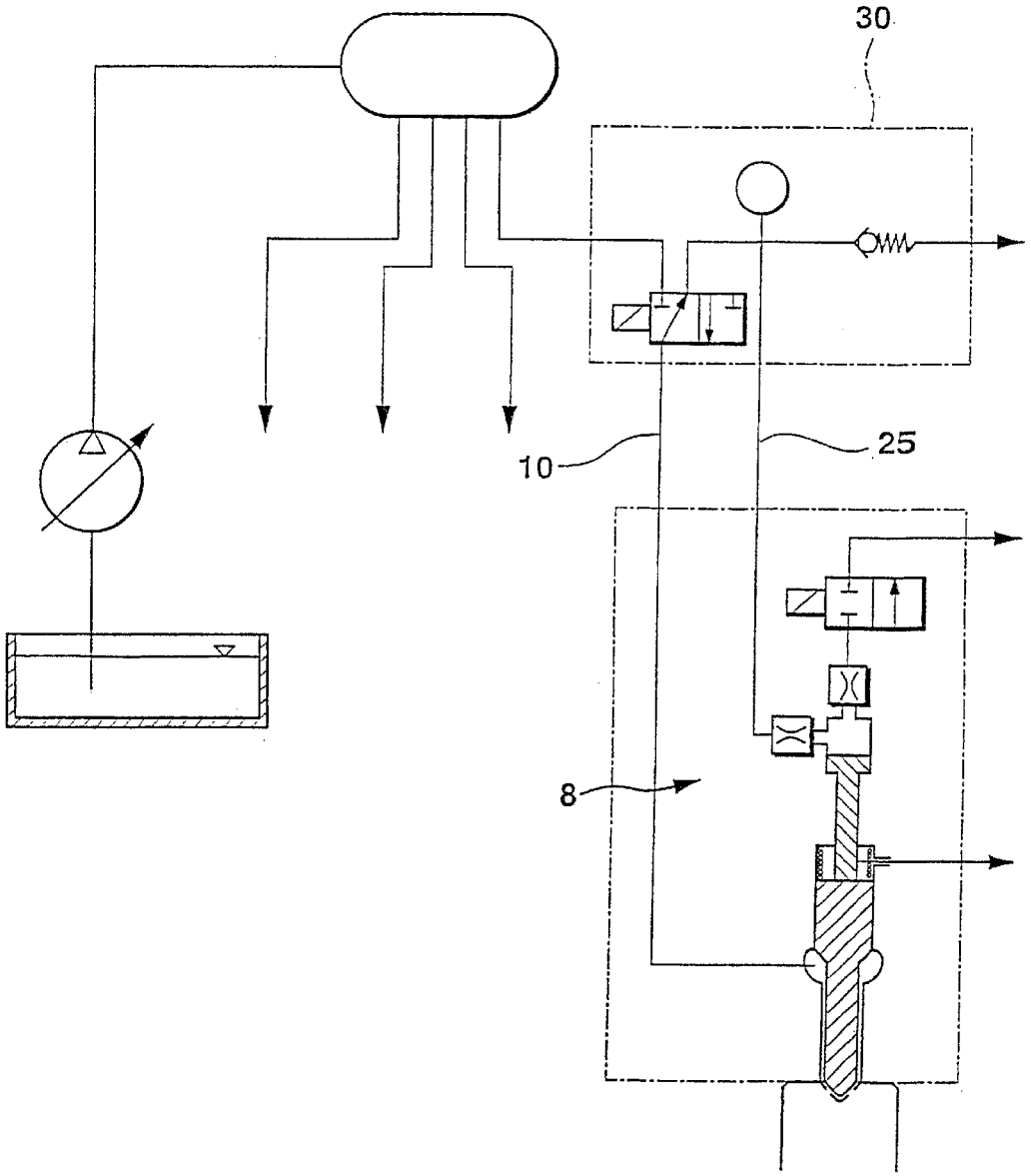

In the first exemplary embodiment, shown in FIGS. 1*a* and 1*b* of a stroke/pressure-controlled fuel injection system 1, a quantity-controlled high-pressure pump 2 pumps fuel 3 out of a tank 4 at high pressure via a feed line 5 into a central pressure reservoir 6 (high-pressure common rail), from which a plurality of high-pressure lines 7, corresponding to the number of individual cylinders, lead away to the individual injectors 8 (injection devices) protruding into the combustion chambers of the internal combustion engine to be supplied. In FIGS. 1*a* and 1*b* only one of the injectors 8 is shown in detail. In the pressure reservoir 6, a first, higher fuel pressure of about 300 bar to 1800 bar can be stored.

The higher fuel pressure prevailing in the high- pressure line 7 is carried via a pressure line 10 into a nozzle chamber 11 of the injector 8, by means of supplying electric current to a 3/2-way valve 9. The injector at the higher fuel pressure (main injection) is effected under pressure control, with the aid of a pistonlike valve member 12 (nozzle needle), which is axially displaceable in a guide bore, and whose conical valve sealing face 13 cooperates with a valve seat face on the injector housing and thus closes the injection openings 14 provided there. Inside the nozzle chamber 11, a pressure face of the valve member 12, pointing in the opening direction of the valve member 12, is exposed to the pressure prevailing there, and the nozzle chamber 11 continues, via an annular gap between the valve member 12 and the guide bore, as far as the valve sealing face 13 of the injector 8. By means of the pressure prevailing in the nozzle chamber 11, the valve member 12 that seals off the injection openings 14 is opened, counter to the action of a closing force (closing spring 15); the spring chamber 16 is pressure-relieved by means of a leakage line 17. By switching the 3/2-way valve 9 back to the currentless state, the main injection is terminated, and the pressure line 10 is made to communicate with a leakage line 20, via a connecting line 18 and a pressure limiting valve 19 that is set to a second, lower fuel pressure (about 300 bar). The leakage line 20 serves the purpose of pressure relief and can lead back to the tank 4. Because of the switchover, the higher fuel pressure that initially still prevails in the pressure line 10 and the nozzle chamber 11 decreases to the lower fuel pressure, which is stored in an accumulator chamber 21 connected to the connecting line 18. This lower fuel pressure is used for the pre-injection and/or post-injection (HC enrichment for exhaust gas post-treatment).

The valve member 12 is engaged coaxially to the closing spring 15 by a pressure piece 22, which with its face end 23 remote from the valve sealing face 13 defines a control chamber 24. From the connecting line 18, the control chamber 24 has a fuel inlet 25 with a first throttle 26 and a fuel outlet to a pressure relief line 27 with a second throttle 28, which can be made to communicate with the leakage line 20 by means of a control device in the form of a 2/2-way valve 29. Via the pressure in the control chamber 24, the pressure piece 22 is urged by pressure in the closing direction. By actuating the 2/2-way valve 29 (supplying electric current to it), the pressure in the control chamber 24 can be decreased, so that as a consequence, the pressure acting in the opening direction on the valve member 12 in the nozzle chamber 11 exceeds the pressure acting in the closing direction on the valve member 12. The valve sealing face 13 lifts from the valve seat face, and thus an injection at the lower fuel pressure takes place. The process of relieving the control chamber 24 and thus the stroke control of the valve member 12 can be varied by way of the dimensioning of the two throttles 26, 28. Closing the 2/2-way valve 29 then terminates this injection. The injection at the lower system pressure can take place either after the main injection in the form of a post-injection, or before the main injection in the form of a pre-injection. If the accumulator chamber 21 is still adequately filled with fuel under pressure after a post-injection, then this fuel can be used in the next injection cycle for a pre-injection, and as a result for each injection cycle, a pre-injection and post-injection are possible. The size of the accumulator chamber 21 is adapted to the requirements of the pre-injection and post-injection, and a sufficiently long pressure line can also perform the function of the accumulator chamber 21.

The arrangement, identified overall by reference numeral 30 in FIG. 1, comprising a 3/2-way valve 9, pressure limiting valve 19 and accumulator chamber 21 can be disposed either inside the injector housing (FIG. 1*a*) or outside it (FIG. 1*b*).

In the description below for the other drawing figures, only the differences from the fuel injection system of FIG. 1 will be addressed. Identical or functionally identical components are identified by the same reference numerals and will not be described in detail again.

Figure 2A:
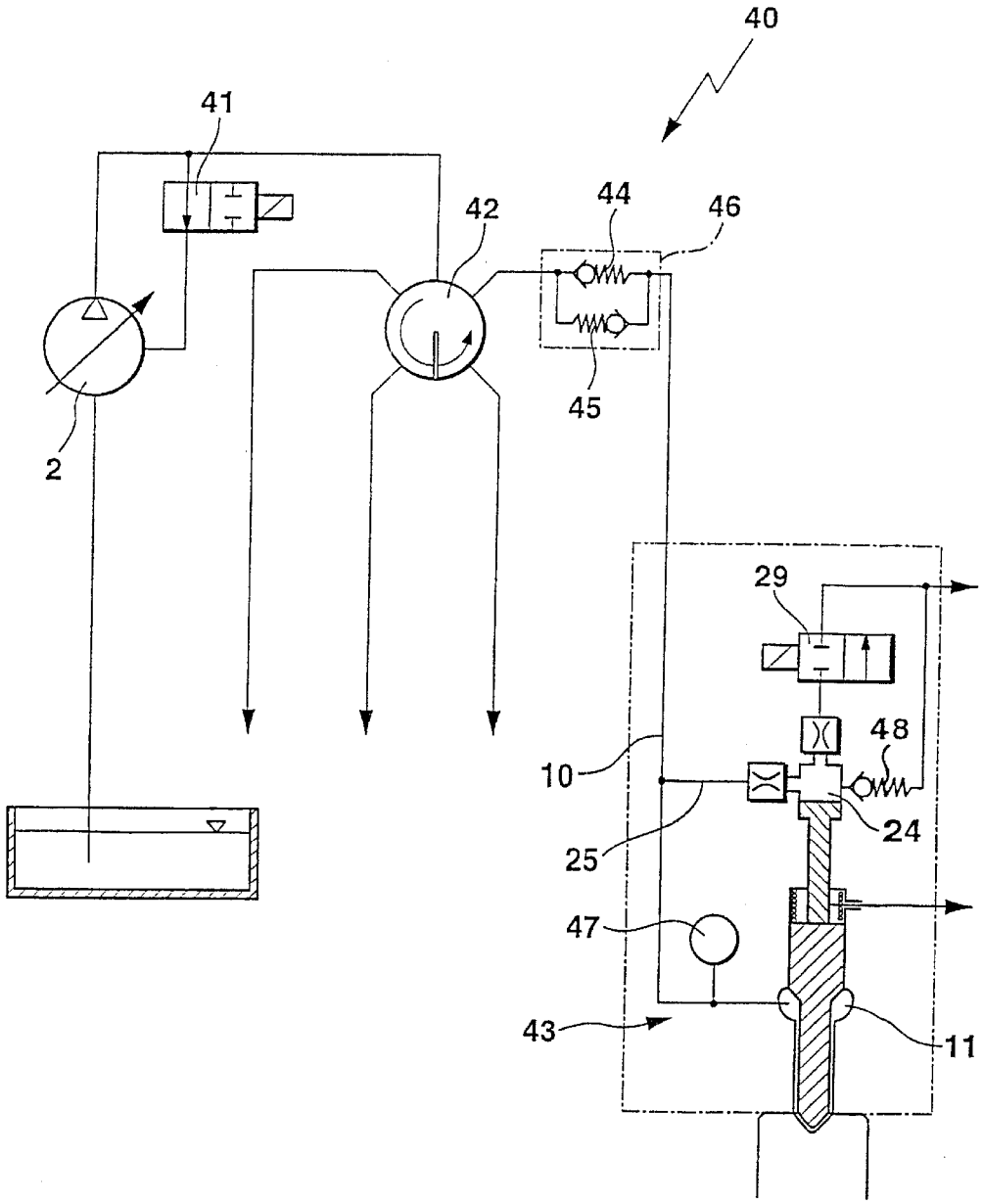
FIGS. 2*a* and 2*b* illustrate a second fuel injection system with a central distributor device, and with one local accumulator chamber for each injector.

In the injection system 40 shown in FIG. 2*a*, the central pressure reservoir of FIG. 1 is left out, and the pressure buildup takes place by the supply of electric current to a 2/2-way valve 41. The high-pressure pump 2 can generate a fuel pressure of approximately 300 to approximately 1600 bar and can for instance be a cam pump. A central distributor device 42 distributes this fuel pressure to the various injectors 43. Downstream of the distributor device 42, for each injector 43, there are also a check valve 44, which admits the fuel in the direction of the injector 43, and a pressure limiting valve 45, which opens at about 300 bar and allows a return flow of fuel out of the injector 43 to relieve the distributor device 42 and reduce the pressure. The check valve 44 and the pressure limiting valve 45 form the valve assembly identified overall by reference numeral 46. Unlike the situation with the injector 8, here the control chamber 24 of the injector 43 has its fuel inlet 25 from the pressure line 10, and the accumulator chamber 47 is disposed in the pressure line 10 immediately upstream of the nozzle chamber 11. The pressure in the control chamber 24 is also limited to about 300 bar via a pressure limiting valve 48. This pressure limiting valve 48 can also be integrated with the 2/2-way valve 29 or with a corresponding magnet valve.

Through the valve assembly 46, the fuel present in the injector 43 is at the lower fuel pressure, when the 2/2-way valve 41 is not supplied with current. By opening the 2/2-way valve 29 (supplying current to it), the pre-injection takes place under stroke control from the local accumulator chamber 47. If as a result of supplying electric current to the 2/2-way valve 41 the higher system pressure is actuated, then the pressure in the nozzle chamber 11 and in the control chamber 24 rises, so that the pressure limiting valve 48 opens, and the pressure there is limited to a lower level. Because of the higher pressure in the nozzle chamber 11, the valve member 12 is opened under pressure control. Upon deactivation of the higher fuel pressure, the pressure in the injector 43 drops, via the pressure limiting valve 45, to the lower fuel pressure, so that the stroke control becomes active again, and the valve member 12 closes.

Figure 2B:
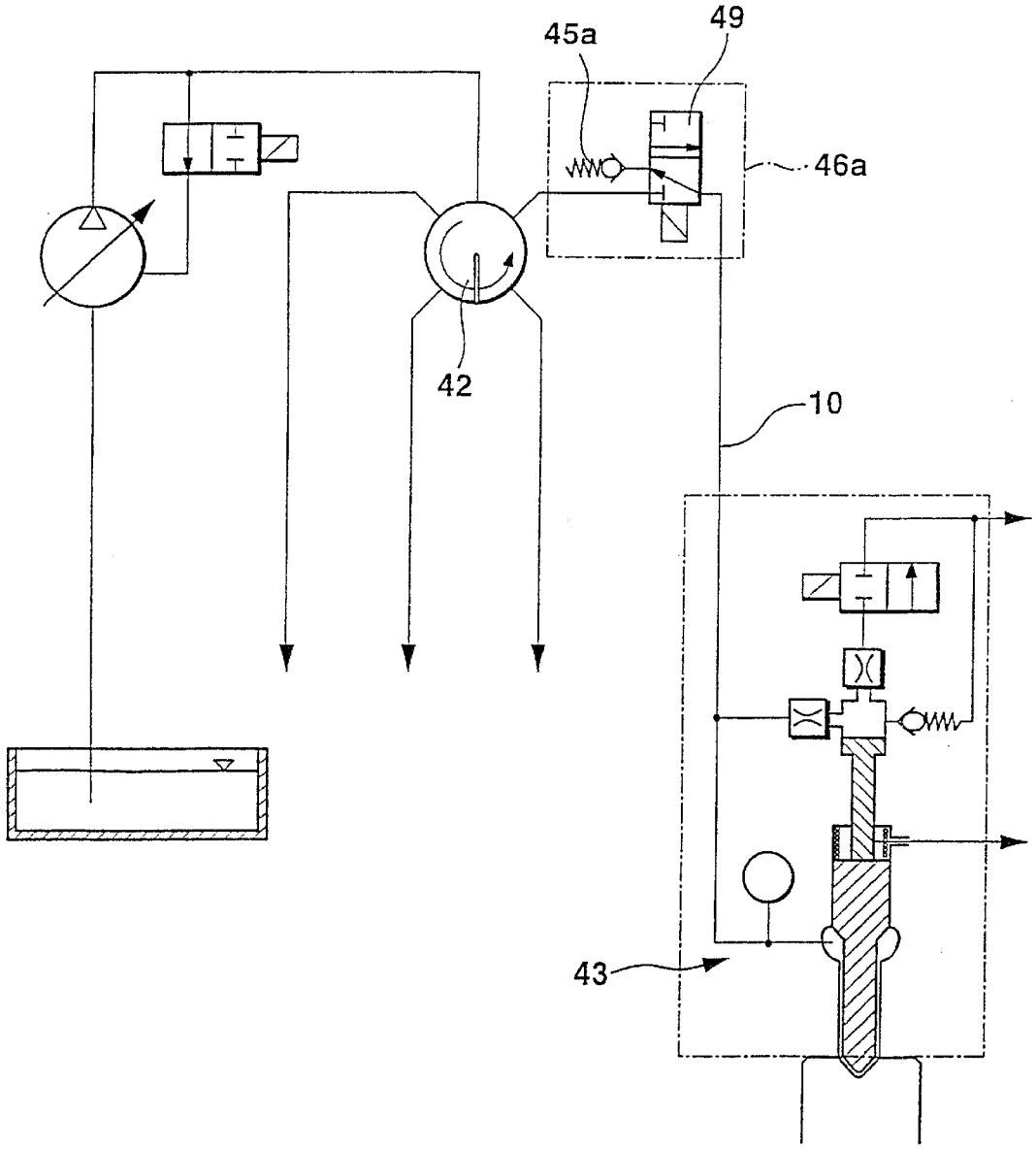

In the exemplary embodiment of FIG. 2*b*, the valve assembly 46*a* that limits the pressure is formed by a 3/2-way valve 49 and by a pressure limiting valve 45*a* that opens at about 300 bar. For the main injection, with the higher fuel pressure actuated, the pressure line 10 communicates with the distributor device 42 via the 3/2-way valve 49. At the end of the main injection, by switching over the 3/2-way valve 49, the pressure prevailing in the injector 43 is then reduced via the pressure limiting valve 45*a* to the lower fuel pressure for a pre-injection and/or a post-injection.

Figure 3A:
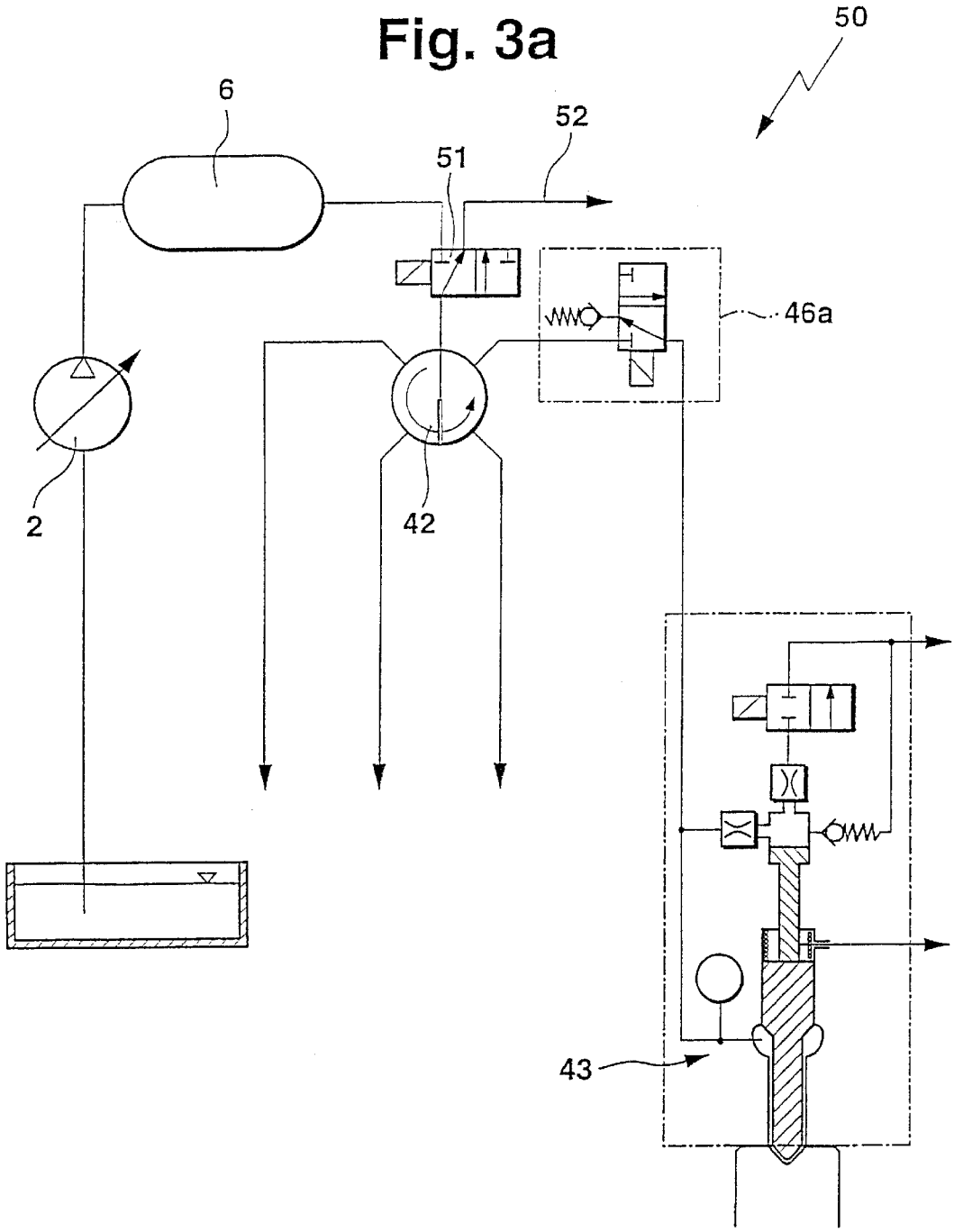
FIGS. 3*a* and 3*b* illustrate a third fuel injection system, with a central pressure reservoir and a central distributor device, and with one local accumulator chamber for each injector.
Figure 3B:
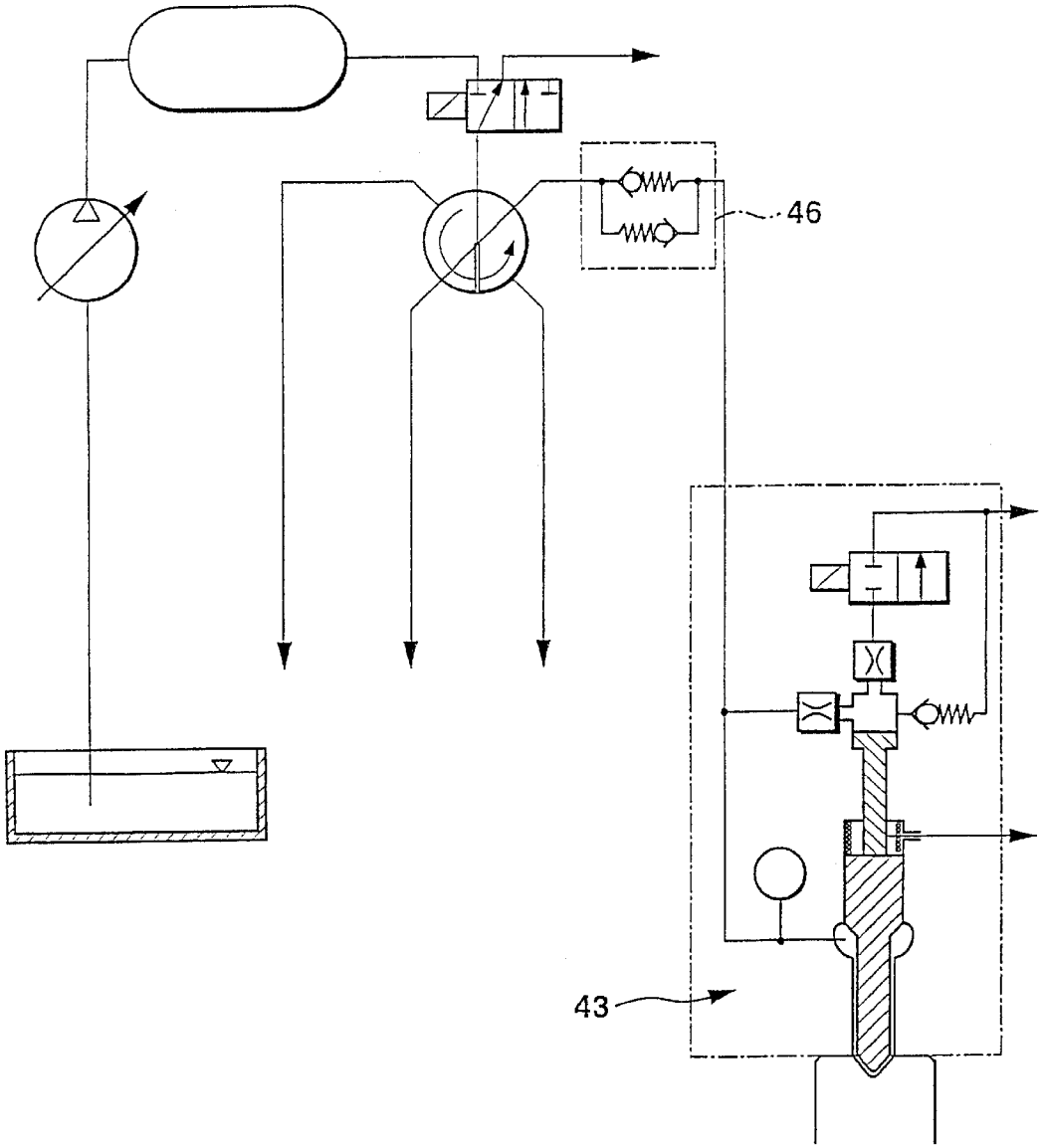

The injection system 50 of FIG. 3, unlike the injection system 40, uses a central pressure reservoir 6 for the higher fuel pressure. Via a 3/2-way valve 51, the distributor device 42 is either made to communicate with the pressure reservoir 6 or is switched back to leakage line 52, in order to relieve the distributor device 42 at the end of the main injection. In FIG. 3*a*, the valve assembly 46*a* is provided, and in FIG. 3*b* the valve assembly 46 is provided.

Figure 4:
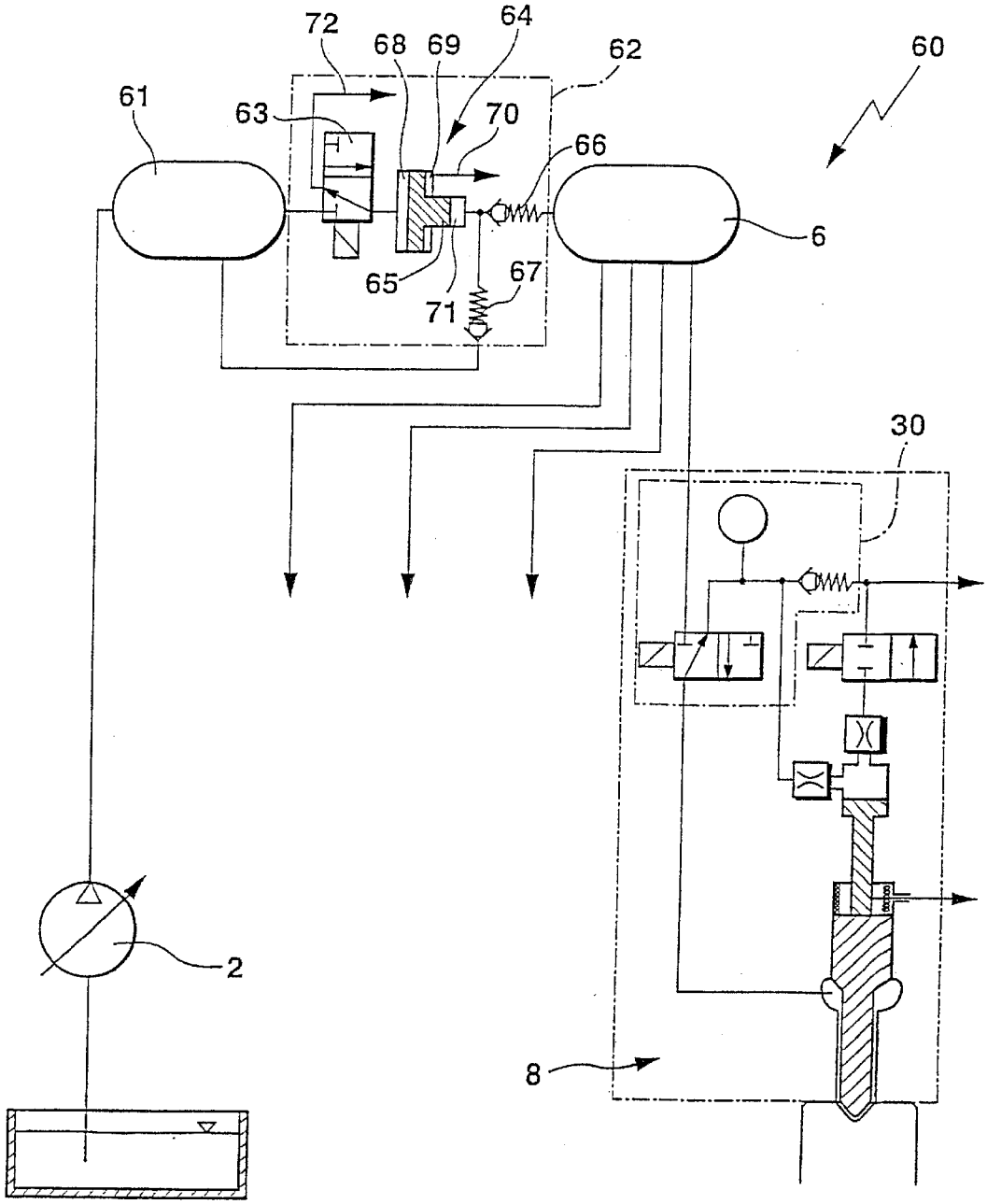
FIG. 4, illustrates a fourth fuel injection system, with two central pressure reservoirs and one central pressure booster, and with one local pressure booster for each injector.

The injection system 60 shown in FIG. 4 is equivalent to the injection system 1, with the exception of the generation of the higher fuel pressure. The high-pressure pump 2 pumps fuel into a first central pressure reservoir 61 (low-pressure common rail). The fuel, stored there at a pressure of about 200 to 600 bar, is compressed by means of a central pressure booster unit 62 to the higher fuel pressure (about 600 to about 1800 bar) and stored in the second central pressure reservoir 6. The pressure booster unit 62 includes a valve unit 63 for triggering the pressure boost, a pressure booster 64 with a pressure means 65 in the form of a displaceable piston element, and two check valves 66 and 67. The pressure means 65 can be connected by one end, with the aid of the valve unit 63, to the first pressure reservoir 61 and is thus acted upon by pressure on one end by the fuel located in a primary chamber 68. A differential chamber 69 is pressure-relieved by means of a leakage line 70, so that the pressure means 65 can be displaced in the compression direction to reduce the volume of a pressure chamber 71. As a result, the fuel located in the pressure chamber 71 is compressed to the higher fuel pressure in accordance with the ratio of the areas of the primary chamber 68 and pressure chamber 71 and is delivered to the second pressure reservoir 6. The check valve 66 prevents the return flow of compressed fuel out of the second pressure reservoir 6. If the primary chamber 68, with the aid of the valve unit 63, is connected to a leakage line 72, the result is the restoration of the pressure means 65 and the refilling of the pressure chamber 71, which is connected to the first pressure reservoir 61 via the check valve 67. Because of the pressure ratios in the primary chamber 68 and in the pressure chamber 71, the check valve 67 opens, and so the pressure chamber 71 is subject to the fuel pressure of the first pressure reservoir 61, and the pressure means 65 is moved hydraulically back into its outset position. To improve the restoration performance, one or more springs can be disposed in the chambers 68, 69 and 71. In the exemplary embodiment shown, the valve unit 63 is shown merely by way of example as a 3/2-way valve.

Figure 5:
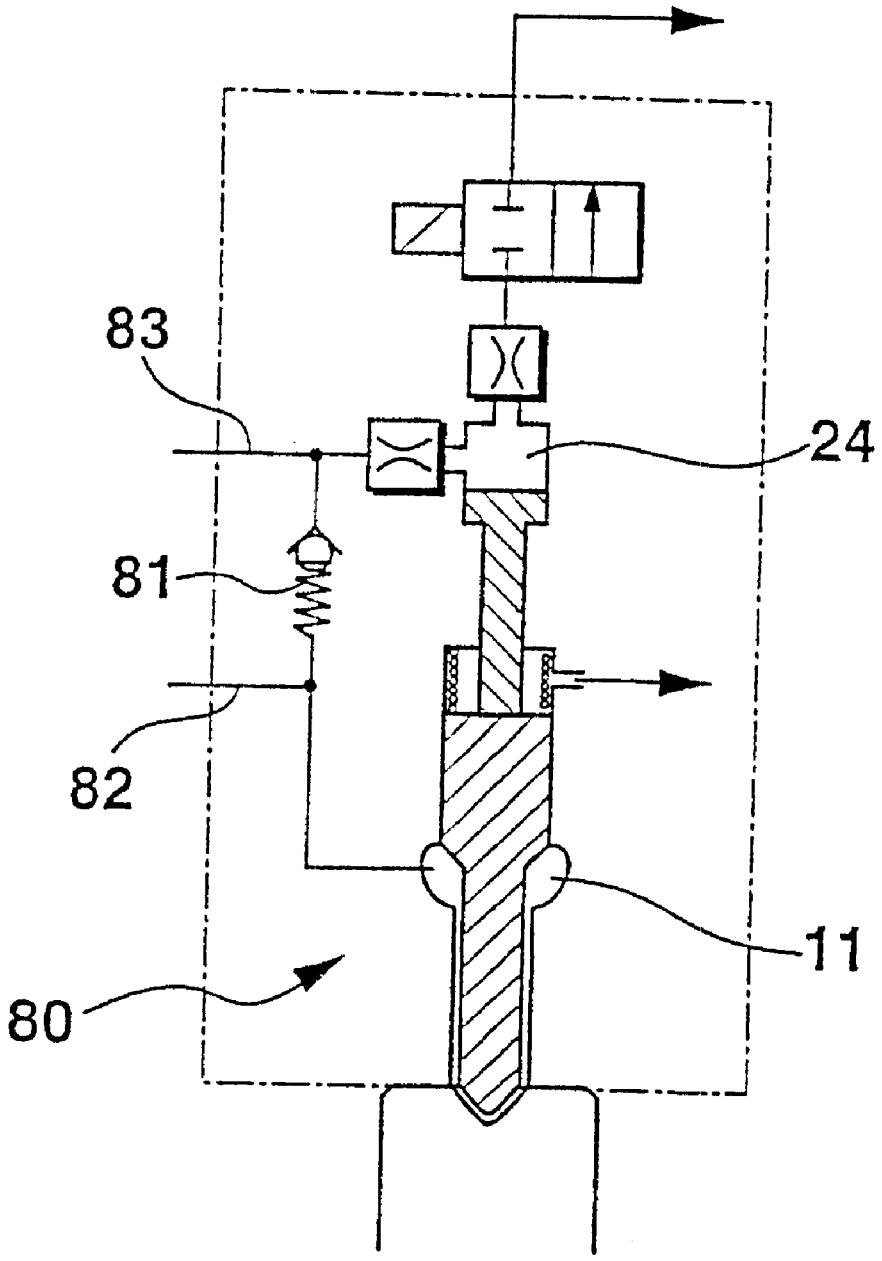
FIG. 5, illustrates an exemplary embodiment of a stroke/pressure-controlled injector.

The injector 80 shown in FIG. 5 has two pressure lines 82, 83, communicating with one another via a check valve 81, for the higher and the lower fuel pressure, respectively, and the control chamber 24 is connected to the pressure line 83. Because the nozzle chamber 11 is subjected to the higher fuel pressure via the pressure line 82, the main injection takes place under pressure control. If via the pressure line 83 the nozzle chamber 11 is subjected to the lower fuel pressure, then the pre-injection or post-injection take place under stroke control.

Figure 6A:
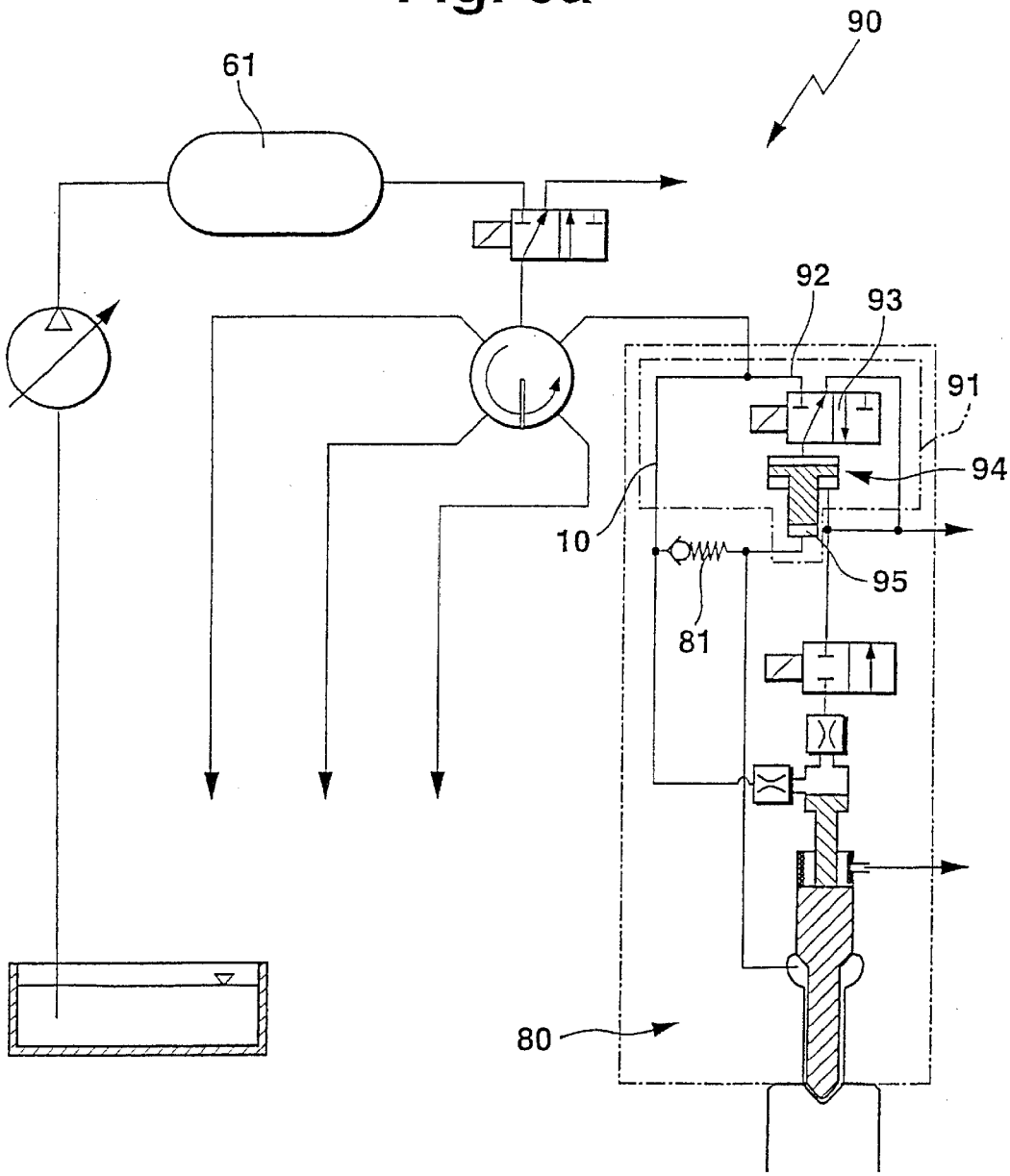
FIGS. 6*a* and 6*b* illustrate a fifth fuel injection system, with the injector shown in FIG. 5, a central pressure reservoir, a central distributor device, and with one local pressure booster for each injector.
Figure 6B:
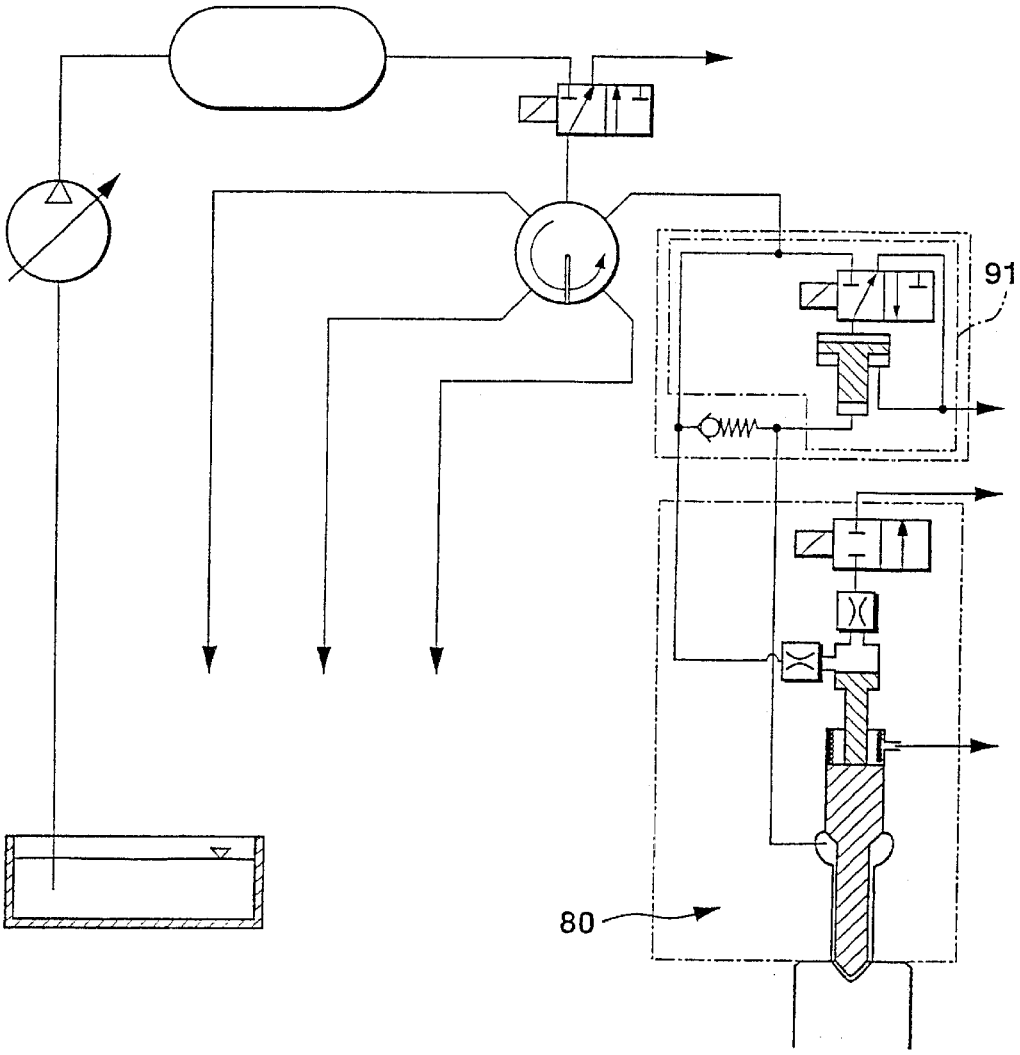

In the injection system 90 of FIG. 6, unlike the injection system 60 (FIG. 4), the fuel pressure stored in the pressure reservoir 61 is used as the lower fuel pressure. From it, a higher fuel pressure can then be generated as well, by means of a local pressure booster unit 91, which is disposed in a bypass line 92 of the pressure line 10. By means of a valve unit 93 (3/2-way valve) in the bypass line 92, a local pressure booster 94, which is constructed analogously to the central pressure booster 64, can be actuated. The pressure chamber 95 of the local pressure booster 94 is filled with fuel from the pressure reservoir 61, and the check valve 81 prevents the return of compressed fuel back into the pressure reservoir 61. The pressure booster unit 91 together with the check valve 81 can be located either inside the injector 80 (FIG. 6*a*) or outside it (FIG. 6*b*).

Figure 7A:
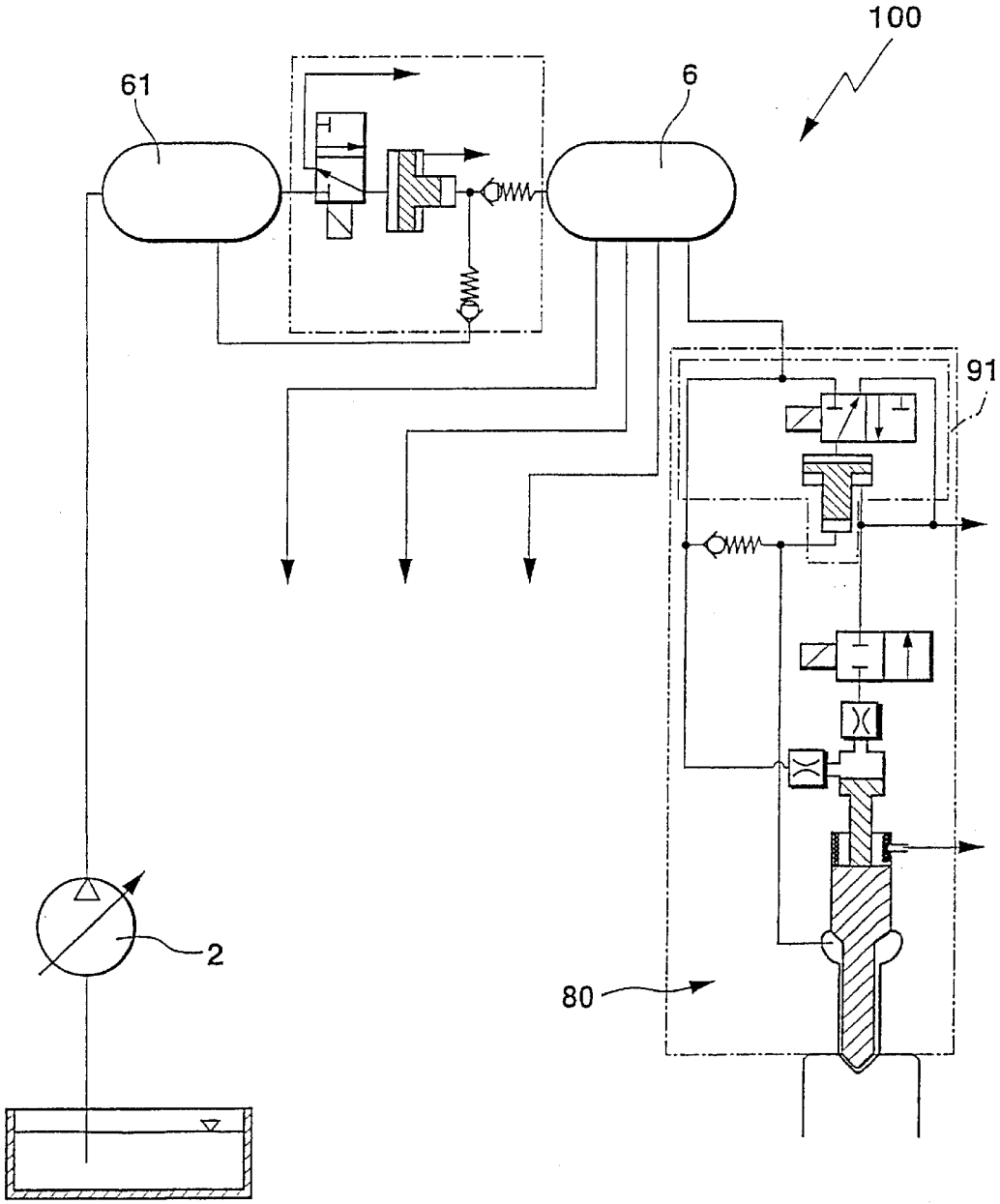
FIGS. 7*a* and 7*b* illustrate a sixth fuel injection system, with the injector shown in FIG. 5 and two central pressure reservoirs, and with one local pressure booster for each injector.
Figure 7B:
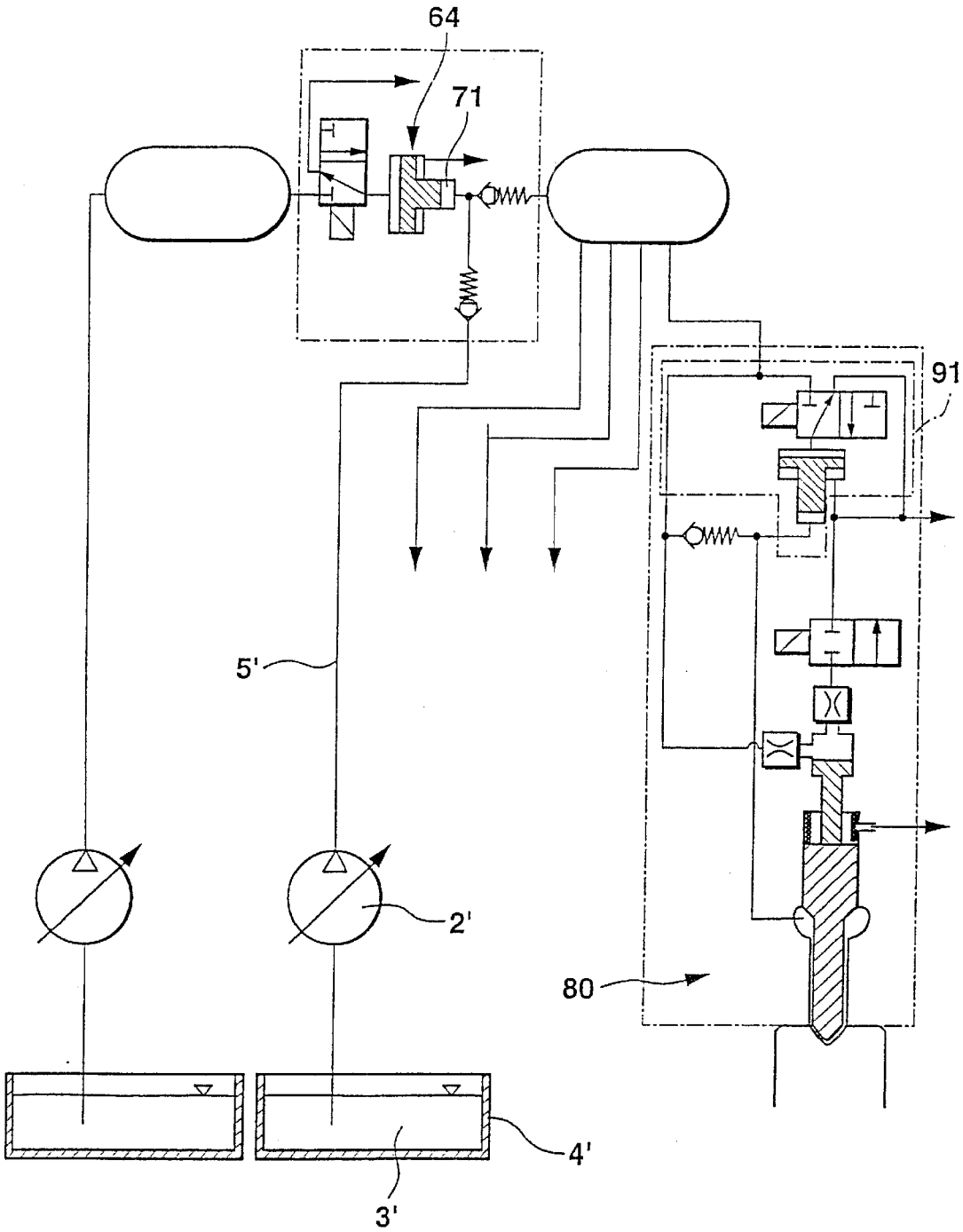

FIG. 7*a* shows an injection system 100, in which unlike the injection system 60 (FIG. 4), the fuel in the second pressure reservoir 6 is stored at the lower fuel pressure. As in FIG. 6, the higher fuel pressure is then generated for each injector 80, by means of the local pressure booster unit 91. In the central, first pressure reservoir 61, the fuel pumped by the high-pressure pump 2 is stored at a pressure of about 50 to about 200 bar. As FIG. 7*b* shows, the pressure chamber 71 of the central pressure booster unit 64 can, instead of being filled with fuel from the first pressure reservoir 61 as in FIG. 7*a*, be filled with fuel 3' that a fuel pump 2' (feed pump) pumps into the pressure chamber 71 from a further tank 4', via a feed line 5'. Since the high- pressure side and the low-pressure side of the central pressure booster unit are hydraulically decoupled from one another, different operating substances can be used, such as oil for the low-pressure side and fuel for the high-pressure side.

Figure 8A:
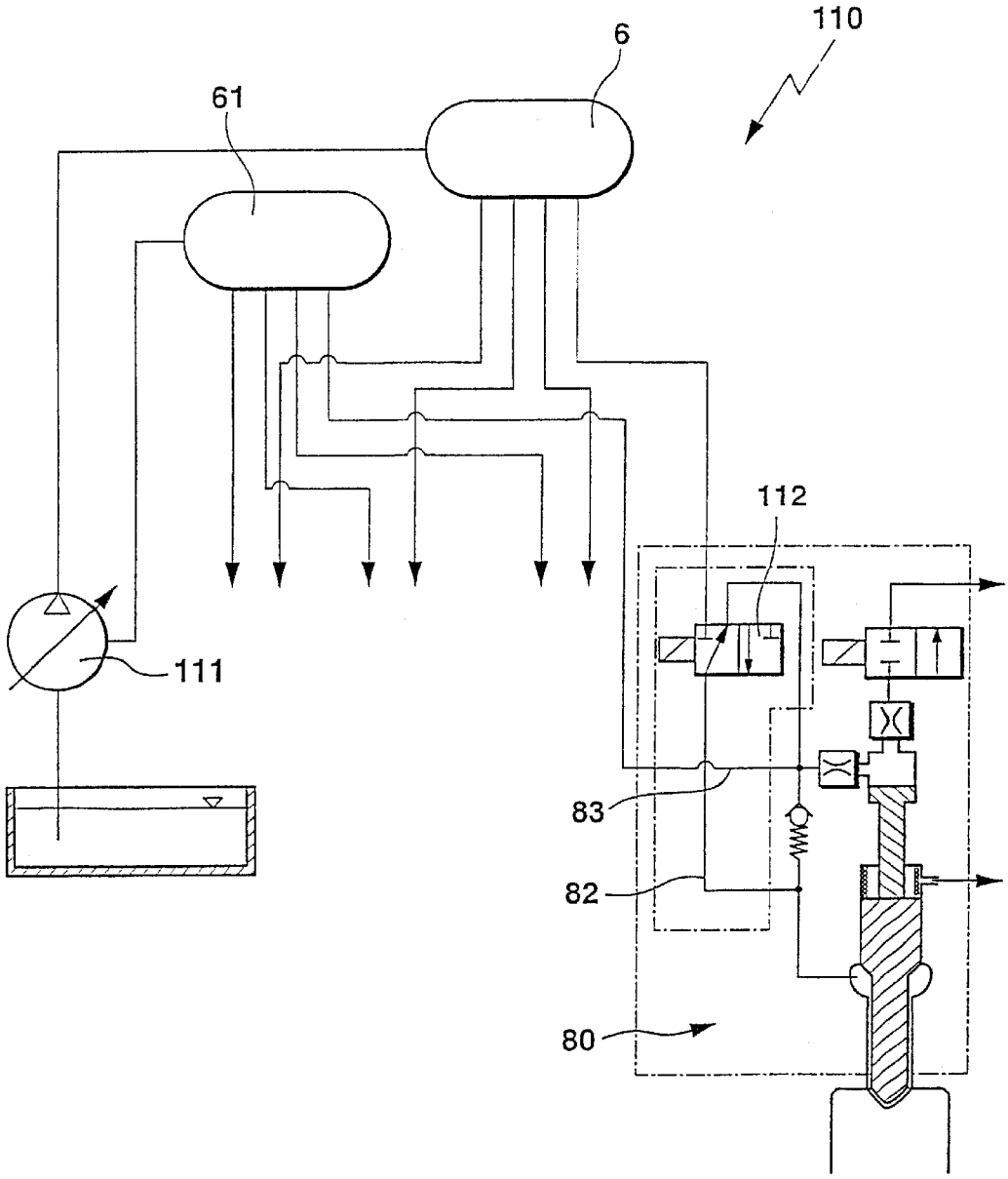
FIGS. 8*a* and 8*b* illustrate a seventh fuel injection system, with the injector shown in FIG. 5 along with two central pressure reservoirs.
Figure 8B:
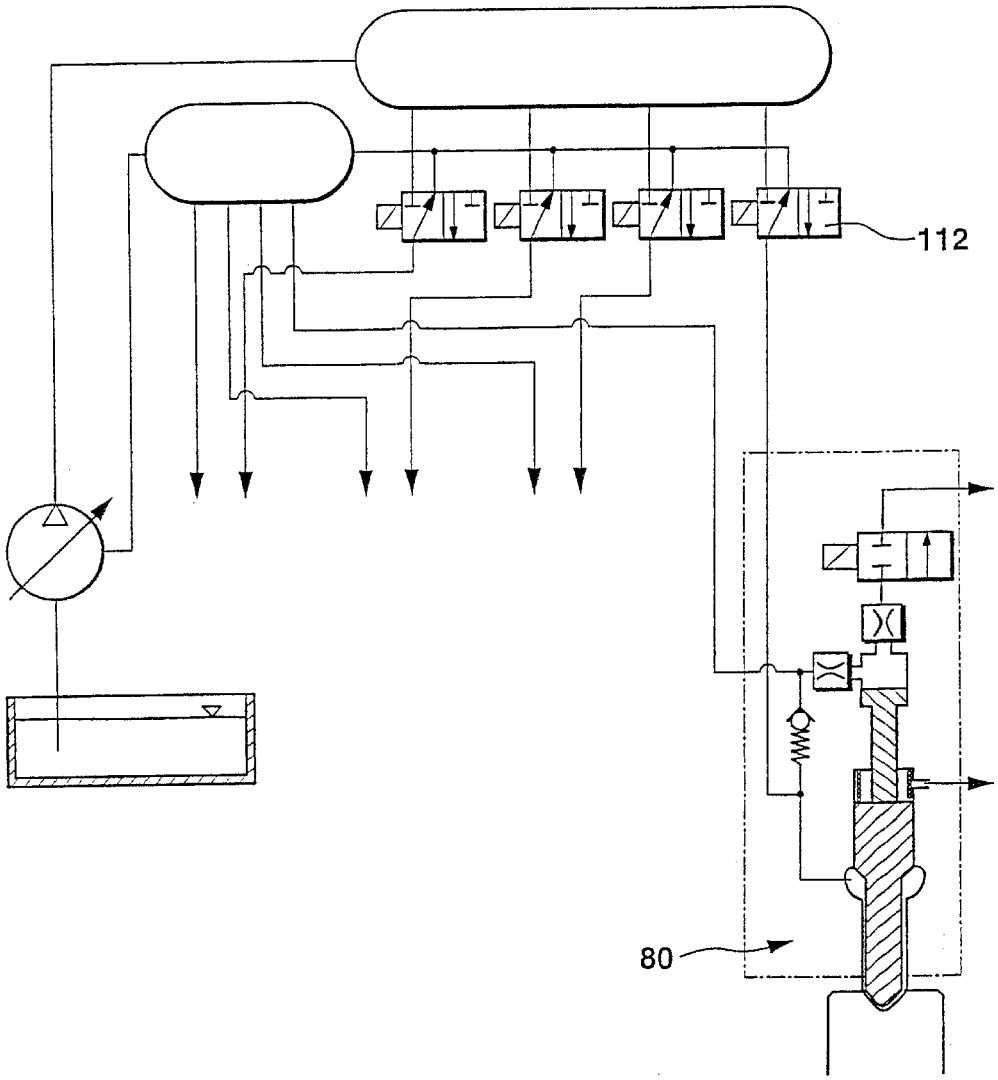
Figure 8C:
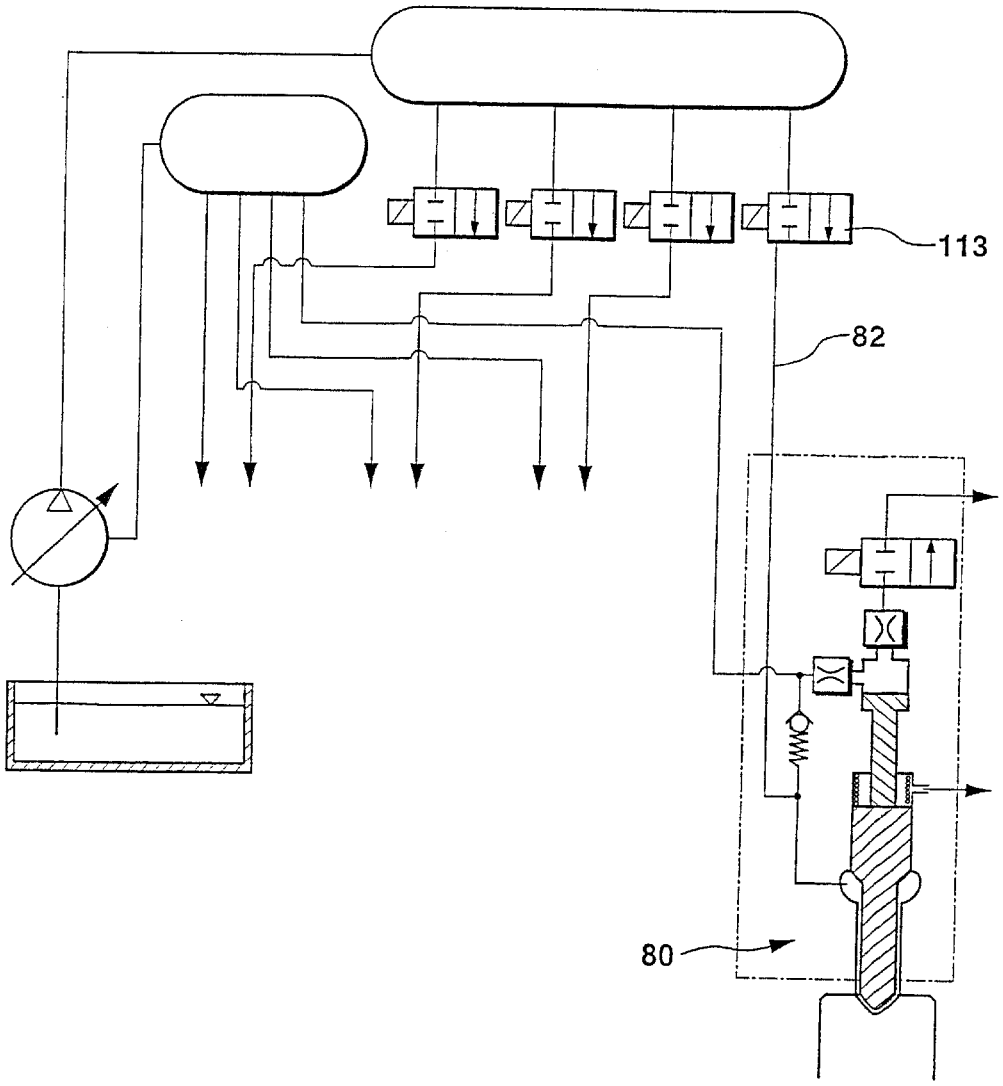

The injection system 110 of FIG. 8 uses a quantity-regulated, two-stage high-pressure pump 111 to generate two differently high fuel pressures, of which the lower is stored centrally in the first pressure reservoir 61 and the higher is stored centrally in the second pressure reservoir 6. The pressure line 83 is connected constantly to the first pressure reservoir 61, while for the main injection the pressure line 82 is connected to the second pressure reservoir 6, via a 3/2-way valve 112. When there is no electric current to the 3/2-way valve 112, the pressure line 82 communicates with the first pressure reservoir 61. The 3/2-way valve 112 can be disposed either inside the injector 80 (FIG. 8*a*) or outside it (FIG. 8*b*). As shown in FIG. 8*c*, a 2/2-way valve 113 can also be provided for switching the higher fuel pressure in the pressure line 82.

Figure 9A:
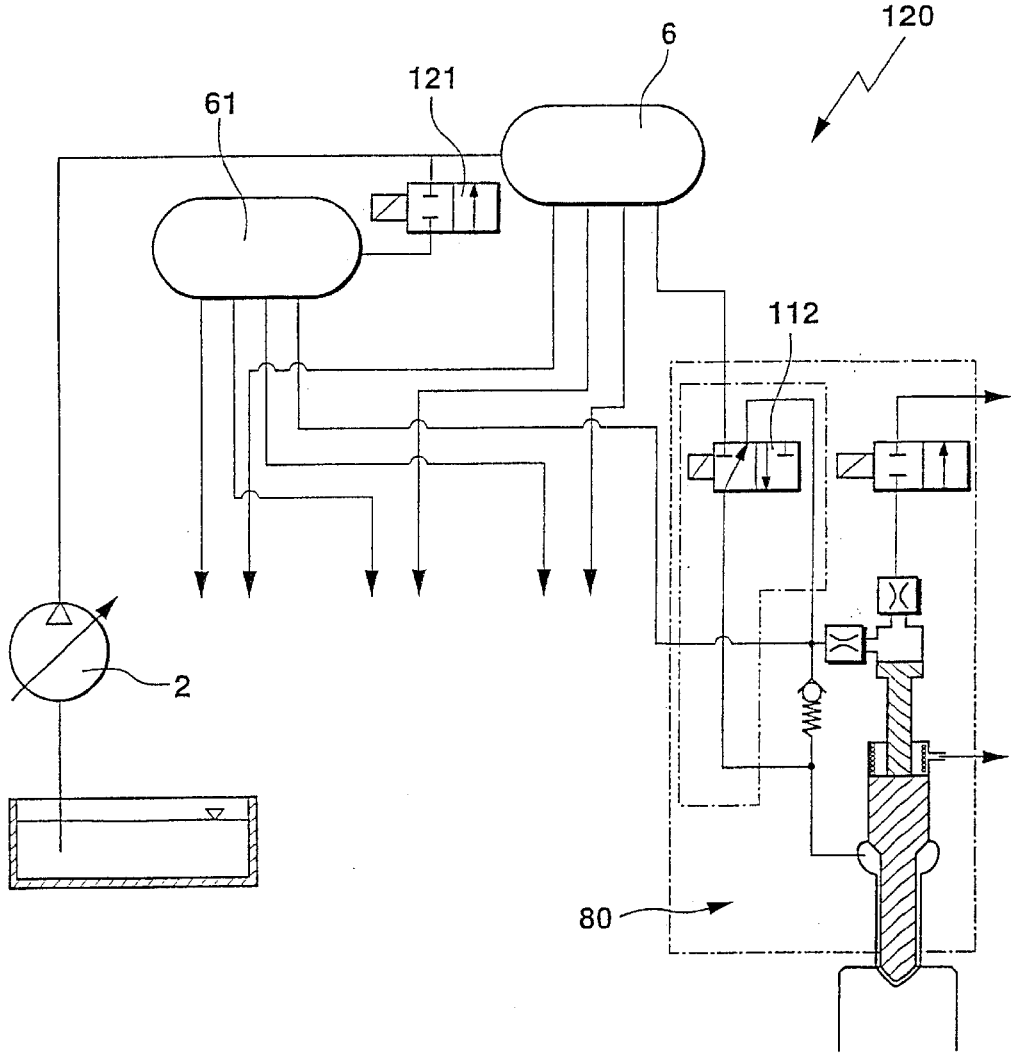
FIG. 9, illustrates a eighth fuel injection system, with the injector shown in FIG. 5 along with two central pressure reservoirs.
Figure 9B:
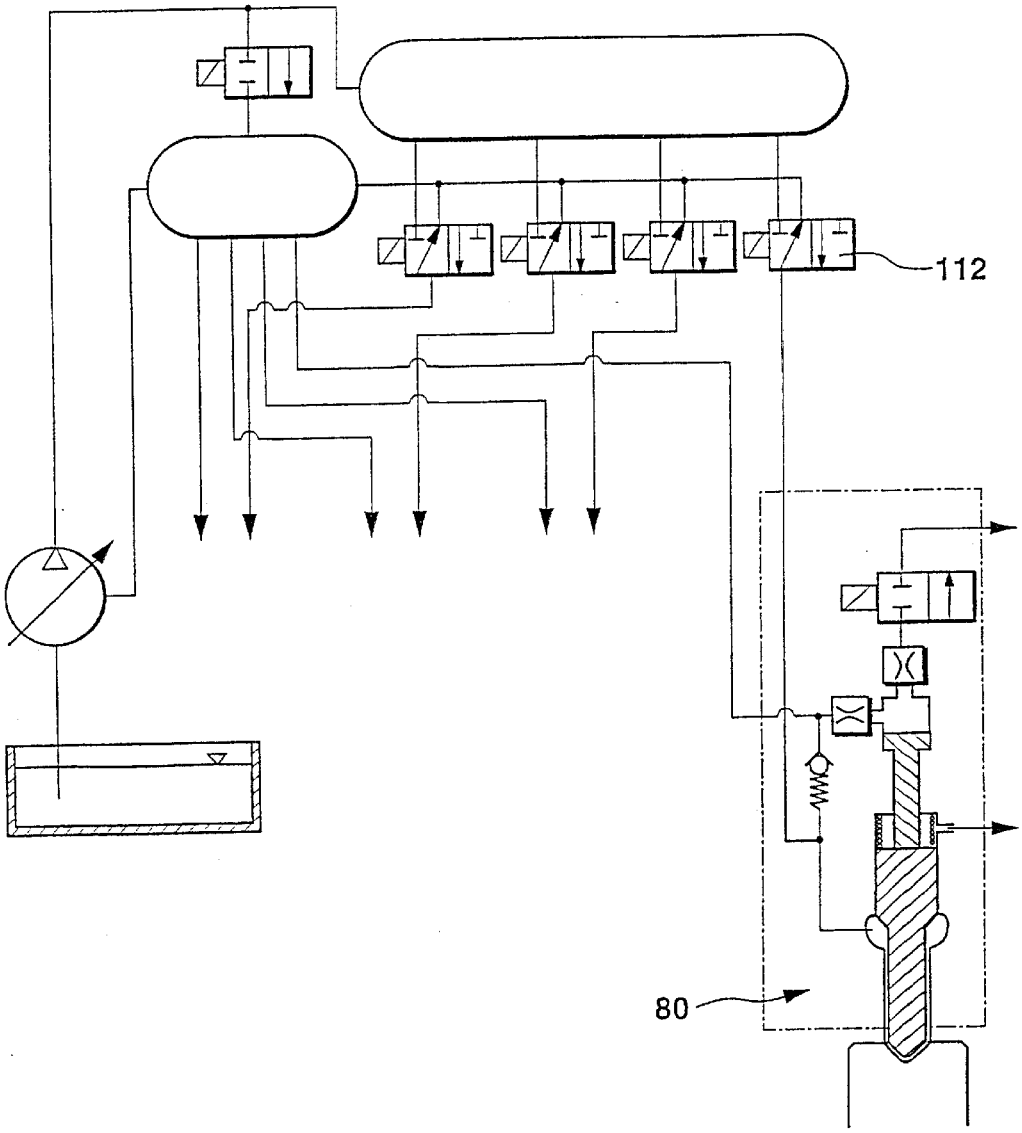
Figure 9C:
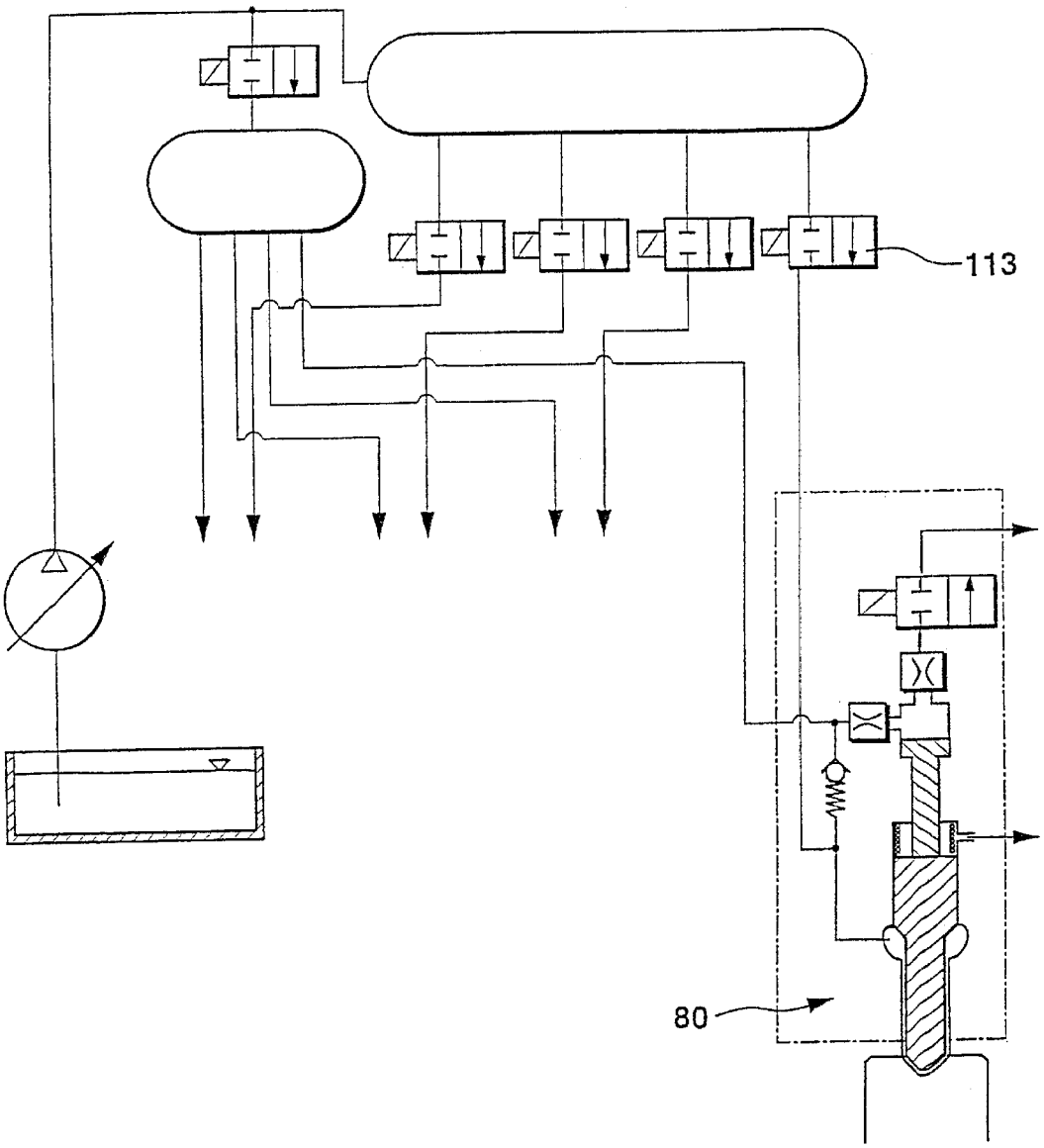

The injection system 120 shown in FIG. 9 differs from the injection system 110 only in that a quantity-regulated single-stage high-pressure pump 2 pumps fuel only into the second pressure reservoir 6, from which fuel is then pumped into the first pressure reservoir 61. By regulation of its fuel supply by means of a 2/2-way valve 121, the lower fuel pressure of about 400 bar is maintained in the first pressure reservoir 61. In FIG. 9*a*, the 3/2-way valve 112 is disposed inside the injector 80, and in FIG. 9*b* it is disposed outside it, while in FIG. 9*c* a 2/2-way valve 113 is provided.

Figure 10:
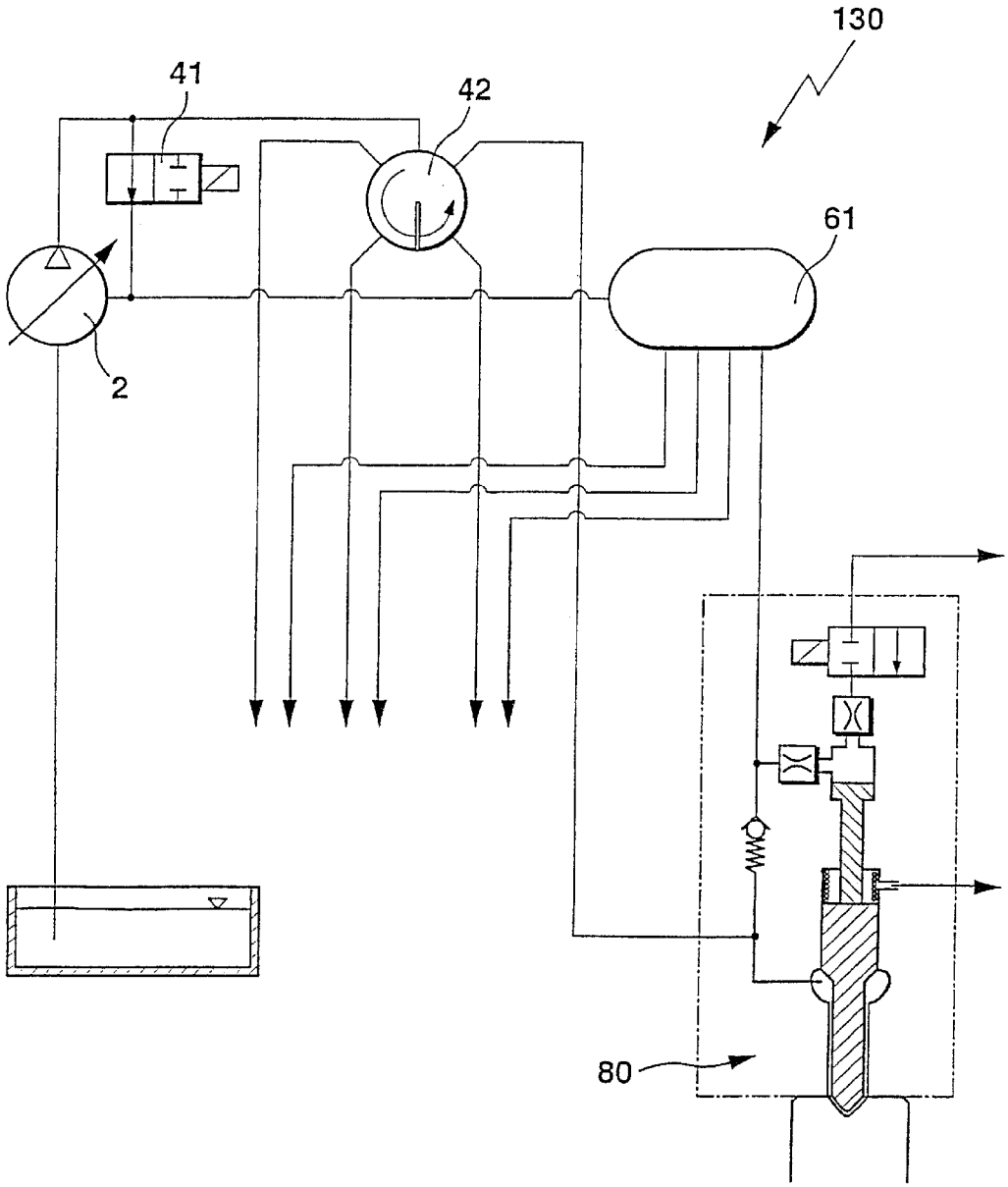
FIG. 10, illustrates a ninth fuel injection system, with the injector shown in FIG. 5, a central pressure reservoir, and a central distributor device.

In a distinction from the injection system 110 of FIG. 8*b*, in the injection system 130 shown in FIG. 10, a two-stage high-pressure pump 2 is used for generating the higher and the lower fuel pressure. The lower fuel pressure is pumped into the central pressure reservoir 61, while the higher fuel pressure is generated by supplying electric current to the 2/2-way valve 41 and is distributed via a distributor device 42 to the individual injectors 80.

Figure 11A:
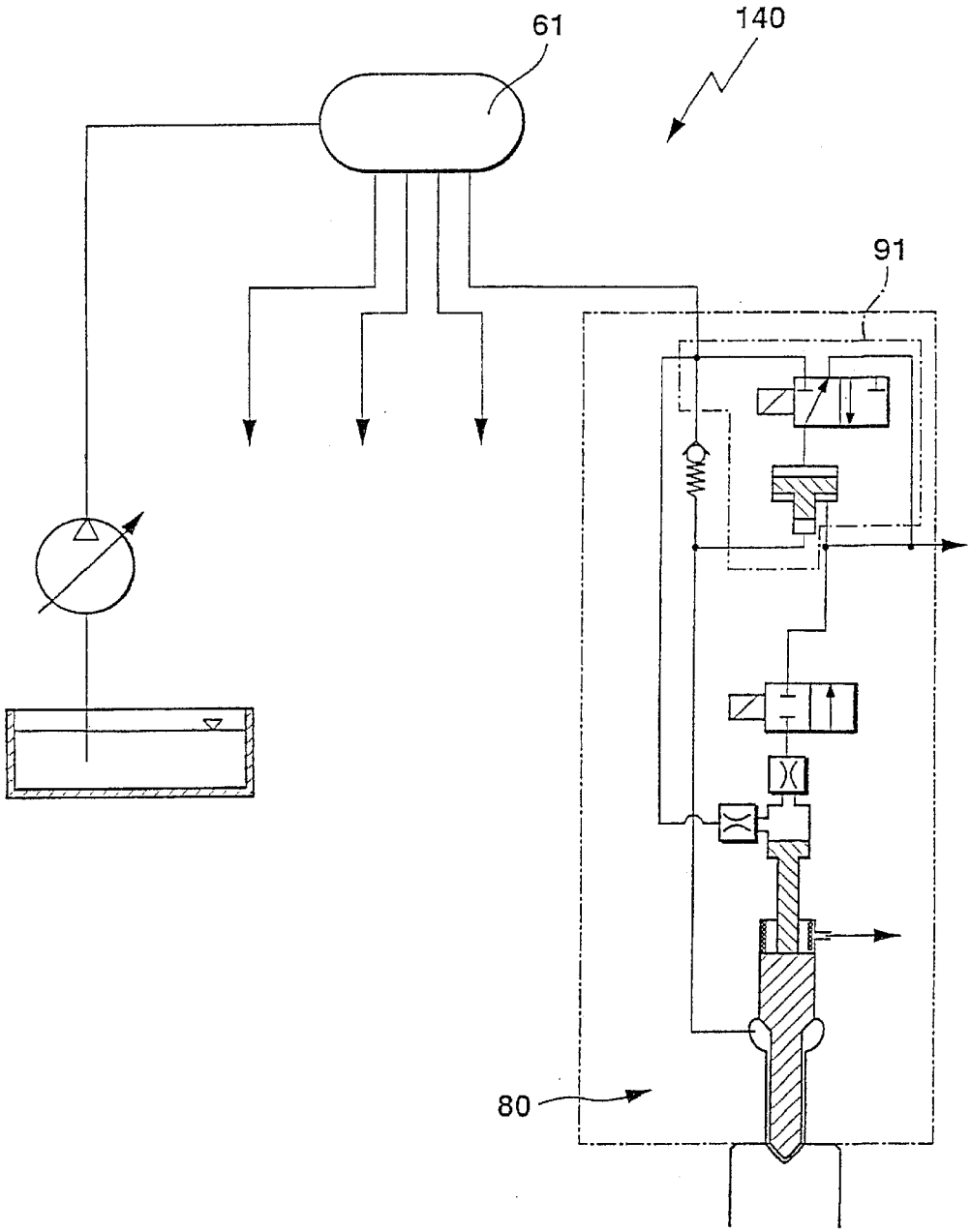
FIGS. 11*a* and 11*b* illustrate a tenth fuel injection system, with the injector shown in FIG. 5, a central pressure reservoir, and with one local pressure booster for each injector.
Figure 11B:
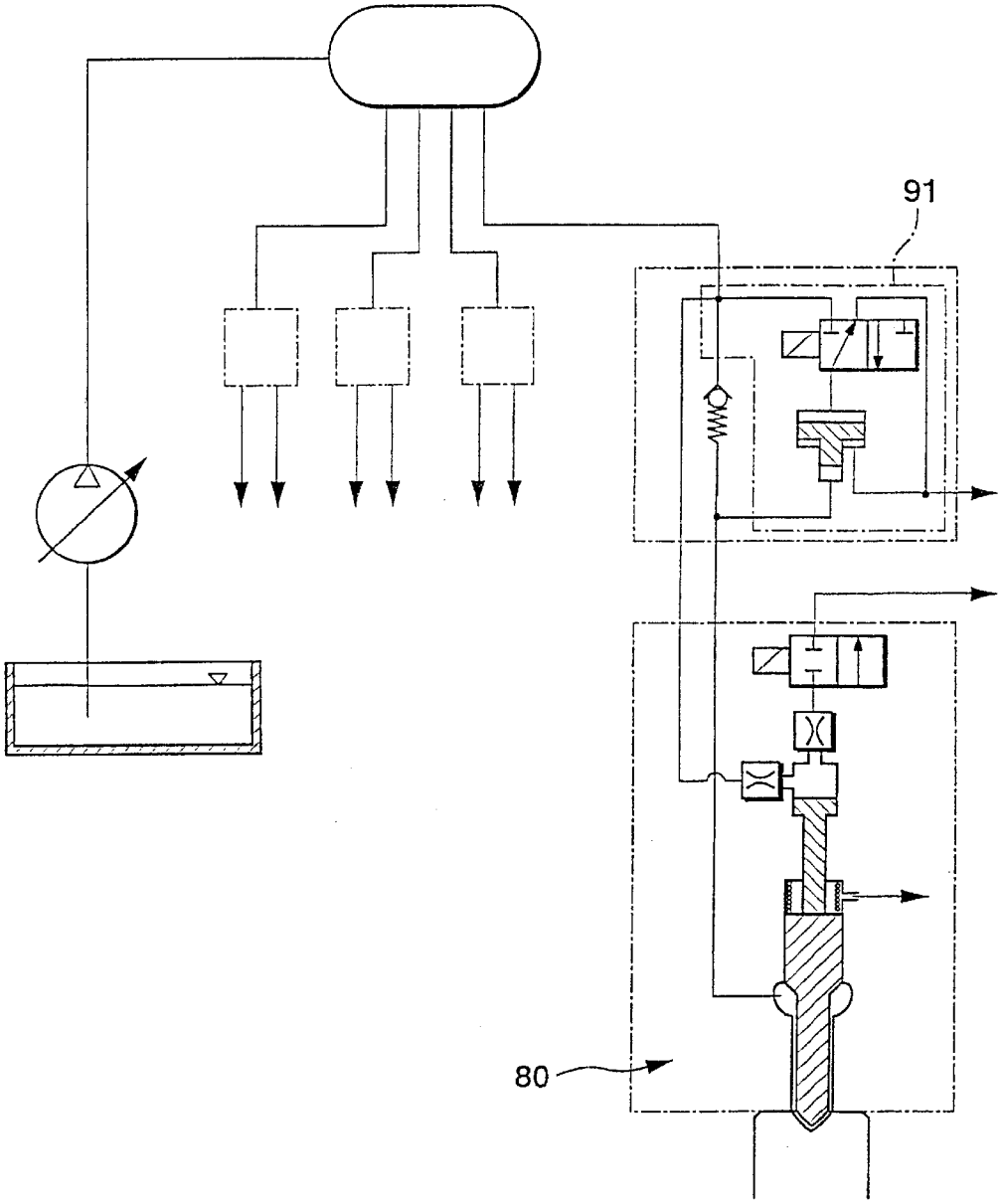

The injection system 140 shown in FIG. 11 differs from the injection system 90 (FIG. 6) in that the lower fuel pressure of the pressure reservoir 61 is not allocated to the injectors 80 via a distributor device; instead, each injector 80 is connected via its own pressure line to the pressure reservoir 61. The local pressure booster unit 91 can be located either inside the injector 80 (FIG. 11*a*) or outside it (FIG. 11*b*). It is furthermore possible, instead of one or both magnet valves, to use piezoelectric actuators. For these piezoelectric actuators, a temperature equalization and optionally a hydraulic coupling should be provided. Both the stroke-controlled injection at the lower fuel pressure and the pressure-controlled injection at the higher fuel pressure can be performed with a piezoelectric actuator instead of a magnet valve. Because of the high actuation speed of a piezoelectric actuator, the metering accuracy of the injection can be improved. A shaping of the injection course (generally in the main injection) can also be achieved. If a piezoelectric actuator is used for the stroke control, then because of the low pressure level to be switched it is optionally possible to dispense with an outflow throttle.

Figure 12:
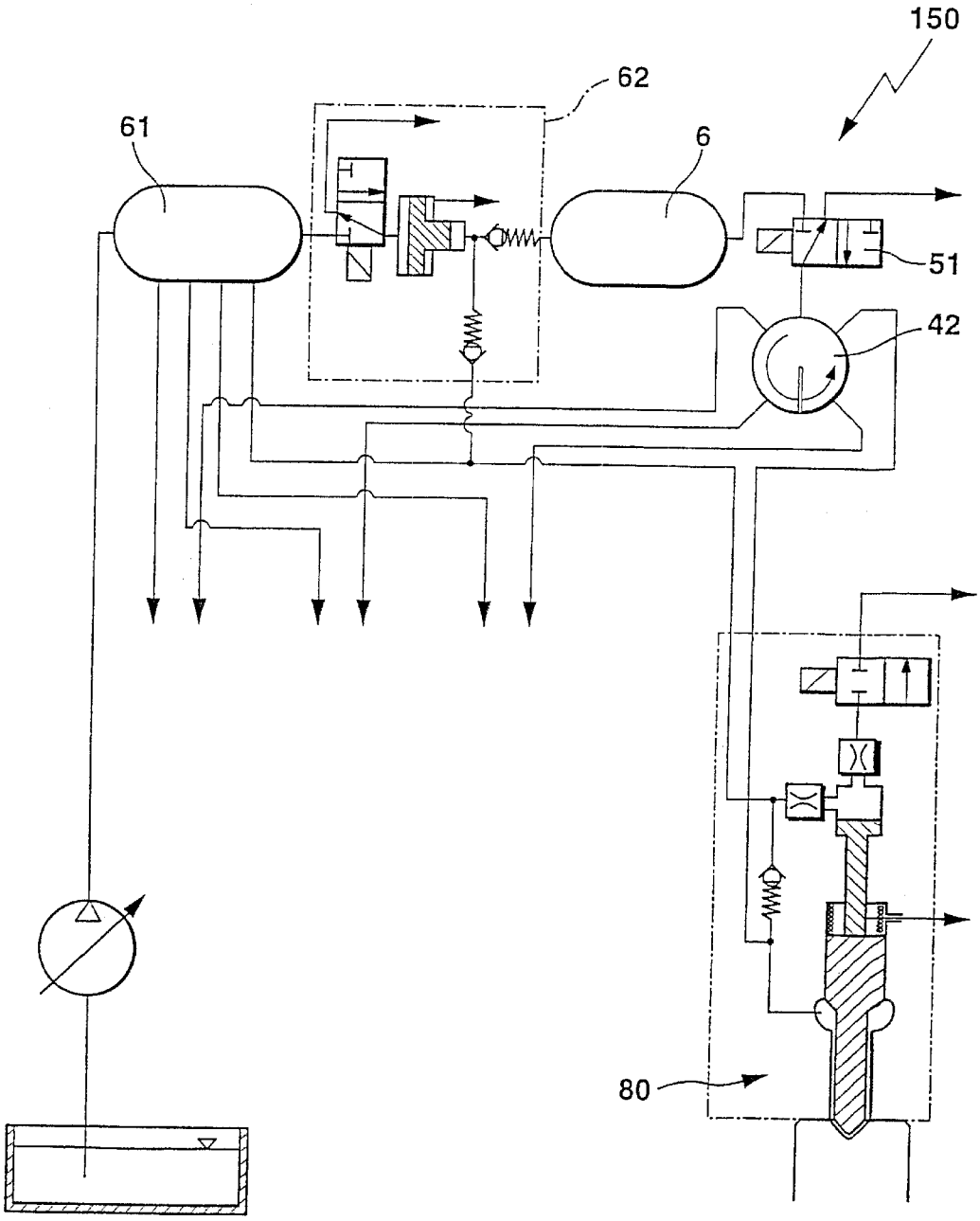
FIG. 12, illustrates an eleventh fuel injection system, with the injector shown in FIG. 5, two central pressure reservoirs, one central pressure booster, and one central distributor device.

The injection system 150 of FIG. 12, like the injection system 110 shown in FIG. 8*b*, uses two pressure reservoirs 6, 61 for the higher and the lower fuel pressure, respectively; in a distinction from FIG. 8*b*, the higher fuel pressure is generated as in FIG. 4 by means of the central pressure booster unit 62, and as in FIG. 3*a*, the higher fuel pressure is distributed centrally via the 3/2-way valve 51 and the distributor device 42 to the injectors 80.

Figure 13A:
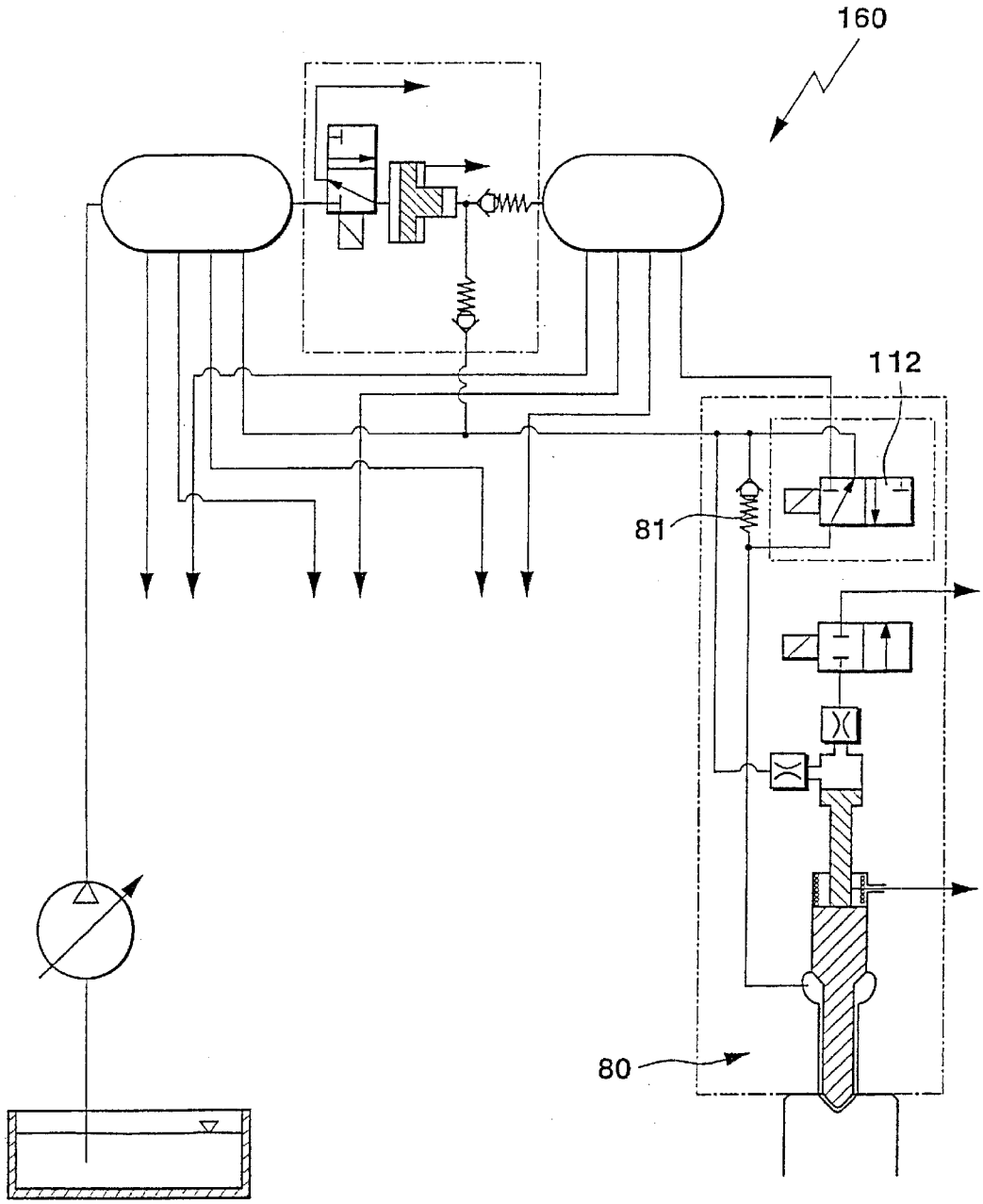
FIGS. 13*a* and 13*b* illustrate a twelfth fuel injection system, with the injector shown in FIG. 5, two central pressure reservoirs, and one central pressure booster.
Figure 13B:
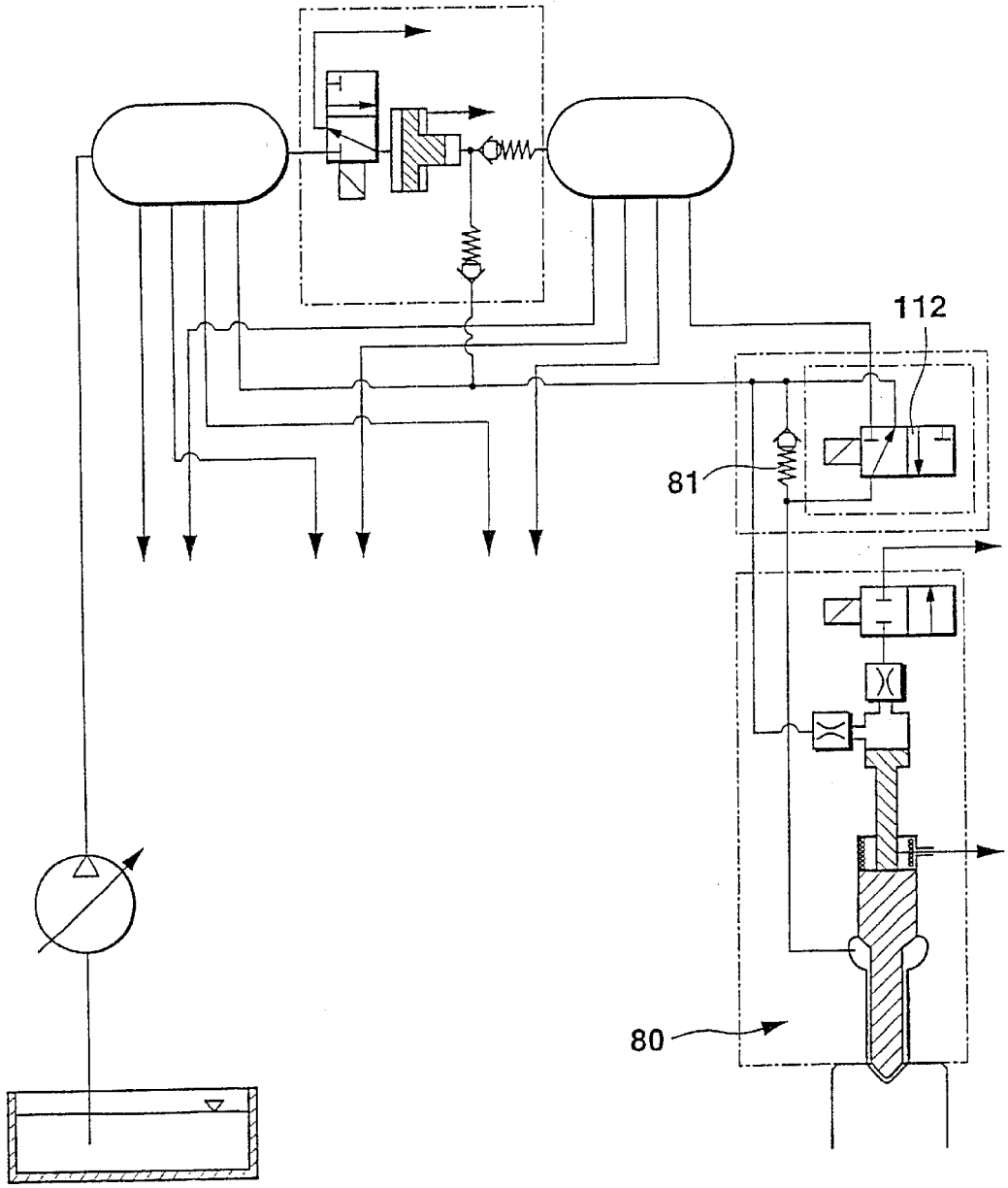

The injection system 160 shown in FIG. 13 differs from the injection system 150 in the use of the injector 80, shown in FIG. 8*a*, in which the higher fuel pressure is metered locally via the 3/2-way valve 112. The 3/2-way valve 112 can be located either inside the injector housing (FIG. 13*a*) or, especially together with the check valve 81, outside it (FIG. 13*b*).

It is also be pointed out that the lower fuel pressure can also be used for the main injection, to achieve a bootlike course of injection.

In a method for injecting fuel at at least two differently high fuel pressures via injectors 80 into the combustion chamber of an internal combustion engine, the fuel injection at the lower fuel pressure takes place under stroke control, and the fuel injection at the higher fuel pressure takes place under pressure control. For a pre- and/or post-injection and/or a boot injection at the lower fuel pressure, the control chamber 24 and via a check valve 81 the nozzle chamber 11 as well are connected to a low-pressure fuel supply, and that for a main injection at the higher fuel pressure, the nozzle chamber 11 is connected to the high-pressure fuel supply.

The foregoing relates to preferred exemplary embodiments of the invention, it being understood that other variants and embodiments thereof are possible within the spirit and scope of the invention, the latter being defined by the appended claims.

We claim:

1. In a method for injecting fuel, at at least two differently high fuel pressures, via injectors (8; 43; 80) into the combustion chamber of an internal combustion engine, in which the fuel injection takes place under stroke control at the lower fuel pressure, the improvement wherein the fuel injection at the higher fuel pressure takes place under pressure control.

2. The injection method of claim 1, wherein after the fuel injection at the higher fuel pressure, the fuel pressure prevailing in the injector (8; 43) is reduced to the lower fuel pressure and is stored locally for at least one fuel injection at the lower fuel pressure.

3. The injection method of claim 1, wherein the pressure control is effected independently of the stroke control.

4. The injection method of claim 2, wherein the pressure control is effected independently of the stroke control.

5. In a fuel injection system (1; 40; 50; 60) for an internal combustion engine, in which fuel is injected at two differently high fuel pressures into the combustion chamber of the internal combustion engine via stroke-controlled injectors (8; 43; 80), and each injector (8; 43; 80) has a respective pistonlike valve member (12), axially displaceable in a guide bore and embodied for sealing off an injection opening (14), which valve member is guided through a nozzle chamber (11) that communicates continuously with the guide bore and can be subjected to pressure, on its end remote from the injection opening (14), in the direction of the injection opening (14) by means of the pressure embodied in a control chamber (24), and a stroke pressure control device (2/2-way valve 29) for pressure relief of the control chamber (24), and the nozzle chamber (11) and control chamber (24) can be connected to a fuel supply, the improvement wherein for a main injection at the higher fuel pressure, the nozzle chamber (11) is connected to a high-pressure fuel supply, and that for a pre- and/or post-injection and/or a boot injection at the lower fuel pressure, the nozzle chamber (11) and the control chamber (24) are connected to an accumulator chamber (21; 47), which during or after the main injection is filled and before the pre- or post-injection is relieved to the lower fuel pressure.

6. The fuel injection system of claim 5, further comprising a device (3/2-way valve 9) which connects the nozzle chamber (11) either to the high-pressure fuel supply or to the accumulator chamber (21).

7. The fuel injection system of claim 6, wherein the accumulator chamber (21) is connected to a pressure limiting valve (19) set to the lower fuel pressure.

8. The fuel injection system of claim 5, wherein the accumulator chamber (47) communicates constantly with the nozzle chamber (11) and the control chamber (24).

9. The fuel injection system of claim 5, wherein the pressure faces of the valve member (12) that are provided in the nozzle chamber (11) and in the control chamber (24) are adapted to one another in such a way that the valve member (12) opens under pressure control, independently of the position of the stroke pressure control device.

10. The fuel injection system of claim 6, wherein the pressure faces of the valve member (12) that are provided in the nozzle chamber (11) and in the control chamber (24) are adapted to one another in such a way that the valve member (12) opens under pressure control, independently of the position of the stroke pressure control device.

11. The fuel injection system of claim 7, wherein the pressure faces of the valve member (12) that are provided in the nozzle chamber (11) and in the control chamber (24) are adapted to one another in such a way that the valve member (12) opens under pressure control, independently of the position of the stroke pressure control device.

12. The fuel injection system of claim 8, wherein the pressure faces of the valve member (12) that are provided in the nozzle chamber (11) and in the control chamber (24) are adapted to one another in such a way that the valve member (12) opens under pressure control, independently of the position of the stroke pressure control device.

13. In a fuel injection system (90; 100; 110; 120; 130; 140; 150; 160) for an internal combustion engine, in which fuel is injected at two differently high fuel pressures into the combustion chamber of the internal combustion engine via stroke-controlled injectors (8; 43; 80), and each injector (8; 43; 80) has a respective pistonlike valve member (12), axially displaceable in a guide bore and embodied for sealing off an injection opening (14), which valve member is guided through a nozzle chamber (11) that communicates continuously with the guide bore and can be subjected to pressure, on its end remote from the injection opening (14), in the direction of the injection opening (14) by means of the pressure embodied in a control chamber (24), and a stroke pressure control device (2/2-way valve 29) for pressure relief of the control chamber (24), and the nozzle chamber (11) and control chamber (24) can be connected to a fuel supply, in particular for injecting fuel at at least two different high pressures into the combustion chamber of the internal combustion engine, in which the fuel injection takes place under stroke control at the lower fuel pressure and under pressure control at the higher fuel pressure, the improvement wherein, for a pre- and/or post-injection and/or a boot injection at the lower fuel pressure, the control chamber (24) and via a check valve (81) the nozzle chamber (11) as well are connected to a low-pressure fuel supply, and that for a main injection at the higher fuel pressure, the nozzle chamber (11) is connected to the high-pressure fuel supply.

14. The fuel injection system of claim 13, wherein the pressure faces of the valve member (12) that are provided in the nozzle chamber (11) and in the control chamber (24) are adapted to one another in such a way that the valve member (12) opens under pressure control, independently of the position of the stroke pressure control device.

* * * * *